US005951109A

United States Patent [19]

Roslund, Jr. et al.

[11] Patent Number: 5,951,109

[45] Date of Patent: Sep. 14, 1999

[54] CHAIRBACK WITH SIDE TORSIONAL MOVEMENT

[75] Inventors: Richard N. Roslund, Jr., Georgetown Township, Ottawa County; Robert T. Ritt, Holland Township, Ottawa County, both of Mich.

[73] Assignee: Haworth, Inc., Holland, Mich.

[21] Appl. No.: 08/846,614

[22] Filed: Apr. 30, 1997

[51] Int. Cl.[6] ..... A47C 1/032

[52] U.S. Cl. ..... 297/383; 297/299; 297/353; 297/301.4

[58] Field of Search ..... 297/299, 301.1, 297/301.3, 301.4, 353, 354.1, 383, 363, 411.32; 248/417; 403/111, 113

[56] References Cited

U.S. PATENT DOCUMENTS

| | | | |
|---|---|---|---|
| 148,380 | 3/1874 | Perrenet . | |
| 693,685 | 2/1902 | Case . | |
| 1,599,941 | 9/1926 | Ammon . | |
| 1,723,415 | 8/1929 | Ferris . | |
| 1,895,226 | 1/1933 | Kupski | 248/417 |
| 2,534,386 | 12/1950 | Stewart . | |
| 2,657,941 | 11/1953 | Adzima | 403/111 X |
| 2,715,938 | 8/1955 | Miller . | |
| 2,748,835 | 6/1956 | Barecki | 297/363 X |
| 3,138,400 | 6/1964 | Reid | 297/363 X |
| 3,156,501 | 11/1964 | Harris | 297/333 |
| 3,223,376 | 12/1965 | Cuittini et al. | 248/417 |
| 3,552,797 | 1/1971 | D'Houdain | 297/355 |
| 3,601,444 | 8/1971 | Doerner | 297/301.3 |
| 3,863,982 | 2/1975 | Sandham | 297/302 |
| 4,030,749 | 6/1977 | Strahm | 297/411.32 X |
| 4,057,213 | 11/1977 | Kokkila | 248/385 |
| 4,095,770 | 6/1978 | Long | 248/371 |
| 4,183,492 | 1/1980 | Meiller | 248/395 |
| 4,372,606 | 2/1983 | Faull | 297/265 |
| 4,377,308 | 3/1983 | Pisanu | 297/353 |
| 4,400,032 | 8/1983 | dePolo | 297/349 |
| 4,425,863 | 1/1984 | Cutler | 114/363 |
| 4,605,334 | 8/1986 | Kalvatn | 403/291 |
| 4,636,001 | 1/1987 | Weyenberg | 297/314 |
| 4,640,548 | 2/1987 | Desanta | 297/320 |
| 4,744,603 | 5/1988 | Knoblock | 297/457 |
| 4,765,617 | 8/1988 | Groves | 273/25 |
| 4,779,922 | 10/1988 | Cooper | 297/188 |
| 4,830,345 | 5/1989 | Mar | 267/133 |
| 4,890,886 | 1/1990 | Opsvik | 297/313 |
| 5,288,127 | 2/1994 | Berg et al. | 297/312 |
| 5,333,934 | 8/1994 | Knoblock | 297/452 |
| 5,372,347 | 12/1994 | Minnich | 248/371 |
| 5,409,295 | 4/1995 | Edstrom | 297/314 |
| 5,487,591 | 1/1996 | Knoblock | 297/452 |
| 5,573,304 | 11/1996 | Glöckl | 297/314 |
| 5,588,704 | 12/1996 | Harza | 297/314 |
| 5,649,740 | 7/1997 | Hodgdon | 297/303 |

FOREIGN PATENT DOCUMENTS

| | | | |
|---|---|---|---|
| 0574375 | 12/1993 | European Pat. Off. . | |
| 2 022 525 | 11/1971 | Germany . | |
| 357144136 | 9/1982 | Japan | 297/354.1 |
| 1 324 451 | 7/1973 | United Kingdom . | |

*Primary Examiner*—Peter R. Brown
*Attorney, Agent, or Firm*—Flynn, Thiel, Boutell & Tanis, P.C.

[57] ABSTRACT

An office-type chair which includes a seat assembly and back assembly that are pivotally supported on a chair base or pedestal to support a user thereon. To increase the comfort of the user, the seat assembly is tiltable forwardly and rearwardly by way of a tilt control mechanism while the back assembly thereof is tiltable laterally from side to side, i.e. in the leftward and rightward directions by way of a back torsion mechanism.

38 Claims, 21 Drawing Sheets

CHAIRBACK WITH SIDE TORSIONAL MOVEMENT

FIELD OF THE INVENTION

This invention relates to an office chair and in particular, to an office chair that includes a seat assembly which is tiltable forwardly and rearwardly and a back assembly which is laterally moveable.

BACKGROUND OF THE INVENTION

Office chairs have been developed where seat and back assemblies thereof are tiltable forwardly and rearwardly. Further, one type of office chair is commonly referred to as a "synchro-tilt" type chair wherein the back assembly tilts synchronously with respect to the seat assembly but at a greater rate. As a result, the back assembly tilts relative to the seat assembly as the latter tilts relative to a chair base on which the seat and back are supported. While numerous improvements to these chairs have been made to improve the comfort of a user, for example, with respect to the synchronous tilt mechanism or with respect to the design of the seat and back assemblies, the tilting of the seat and back assemblies in office chairs primarily permits tilting forwardly and rearwardly in a single vertical plane.

For example, a number of office chairs use plastic inner shells for the seat and back which are formed separately in two pieces or together as a single L-shaped piece. The inner shell for the chair back, however, is supported by a rigid back upright member that is pivotally connected to the seat assembly so as to move forwardly and rearwardly. While the plastic inner shell has some flexibility, such chairs typically use rigid armrests which limit the range of motion of a user. Also, the upright member is rigid which limits the flexure of the chair shell particularly in the lumbar region of a user. Further, these chairs typically include plastic outer shells which are secured to and cover the back surface of the inner shell and effectively limit flexing of the inner shell even further.

Previous attempts have been made to provide chairs which have an expanded range of motion primarily in the backrest.

In one example, U.S. Pat. No. 148,380 (Perrenet) discloses a chairback joined to the seat by a ball-and-socket joint which permits movement in most directions except in a backward direction. This arrangement also includes a harness which is secured onto the shoulders of a user.

In another example, U.S. Pat. No. 3,552,797 (D'Houdain) discloses a chair for dental treatment having a stationary seat and a backrest. The backrest has an upper section which pivots about an axis Y–Y' that is located at a height spaced upwardly above the waist of a user seated thereon. The lower section of the backrest, however, supports a tilt mechanism for rearward tilting of the seat back about an axis X—X which is located above the seat of a user.

Accordingly, it is an object of this invention to provide an improved office-type chair which provides for lateral tilting of the back assembly relative to a seat assembly and particularly, has a laterally movable back which is self-centering so as to normally maintain the chairback in a vertical upright position. It is a further object that the back assembly be tiltable laterally or sidewardly about a first generally horizontal pivot axis which extends in a forward-rearward direction while the seat assembly is tiltable forwardly and rearwardly about a second horizontal pivot axis which extends sidewardly. It is an object therefore that this improved chair provide three-dimensional tilting where the seat assembly is movable forwardly and rearwardly and the back assembly is movable laterally. It is still a further object that the first pivot axis of the back be located below the level of the seat assembly such that the entire back is movable sidewardly and that the amount of force required for lateral movement of the back be adjustable.

In view of the foregoing, the invention relates to an office-type chair which includes a seat assembly and back assembly that are pivotally supported on a chair base or pedestal to support a user thereon. To increase the comfort of the user, the seat assembly is tiltable forwardly and rearwardly by way of a tilt control mechanism while the back assembly thereof is tiltable laterally from side to side, i.e. in the leftward and rightward directions by way of a back torsion mechanism.

Generally with respect to the main components of the chair, the base is adapted to be supported on a floor and the seat assembly is mounted to the base by the tilt control mechanism. The tilt control mechanism thereby permits forward and rearward tilting of the seat assembly relative to the base, which forward and rearward tilting is conventional. Further, the inventive chair includes the back torsion mechanism which joins the back assembly to the seat assembly. The back torsion mechanism thereby provides a fixed connection therebetween such that the back assembly pivots rearwardly in combination with rearward tilting of the seat assembly. At the same time, the back torsion mechanism also defines a forwardly extending horizontal pivot axis whereby the back assembly can be pivoted to the left and right sides. This combination of forward-rearward tilting and torsional movement thereby accommodates the movements of a user.

The back torsion mechanism not only permits lateral tilting of the back assembly, but also is self-centering in that it includes self-centering means for returning the back assembly to a normally upright position.

More particularly, the back torsion mechanism generally includes a pair of mounting plates which are welded to the back support member so as to move therewith and support a hollow cylindrical bearing therein. The upright member of the back assembly includes a shaft projecting forwardly therefrom which is slidably received within the cylindrical bearing so as to define the horizontal pivot axis extending forwardly and rearwardly about which the back assembly is sidewardly movable. The first horizontal pivot axis preferably is disposed below the level of the seat assembly such that the entire back is movable sidewardly.

The back torsion mechanism also includes self-centering means which normally maintains the back assembly in the vertical central position while permitting the reversible sideward movement thereof. The centering means preferably includes a transverse pin which projects radially outwardly from a front end of the rotatable shaft. The transverse pin seats within corresponding camming grooves on a front surface of the bearing. The camming grooves are defined by an arcuate bearing surface along which the transverse pin can slide during rotation of the back assembly. A compression spring tends to urge the transverse pin back into the camming groove so as to seat in the deepest portion thereof whereby the back assembly is returned to the vertical upright position.

Preferably, the back torsion mechanism also includes tension adjustment means for adjusting the force being applied by the centering spring which increases and decreases the resistance to torsional movement. Further, the back torsion mechanism also includes a locking arrangement to selectively lock out the torsional movement if desired.

While the mounting plates and bearing are formed as separate components, these components may also be formed in a further embodiment as a single metal part which is welded onto the back support member. This metal component is formed with camming grooves and thereby operates substantially the same as the embodiment described above.

Still further, while the first and second embodiments are usable in chairs in both one-piece and two-piece flexible shells, another embodiment of the back torsion mechanism may also be provided in an office chair having the one-piece inner shell instead of separate seat and back assemblies. In this arrangement, the chair includes an L-shaped upright member which is pivotally connected at a front end thereof to a tilt control mechanism. The upright member extends both rearwardly and upwardly to provide support to the back of the one-piece inner plastic shell.

The L-shaped upright member preferably is formed of a horizontal member pivotally connected to the tilt control mechanism, and a vertical member. The horizontal and vertical members are joined together by pivot means such as a thrust bearing such that the vertical member pivots sidewardly relative to the horizontal member.

When the one-piece inner plastic shell is connected both to the tilt control mechanism and the vertical portion of the upright member, the inner plastic shell serves as centering means for the tilt control mechanism. In particular, the inner shell is resiliently flexible such that a back portion thereof is movable sidewardly relative to a seat portion thereof. The seat portion, however, is fixed in place on the tilt control mechanism. Since the inner shell is resiliently flexible, the shell urges the seat back to a normally upright position when not in use.

Other objects and purposes of the invention, and variations thereof, will be apparent upon reading the following specification and inspecting the accompanying drawings.

Figure 1:
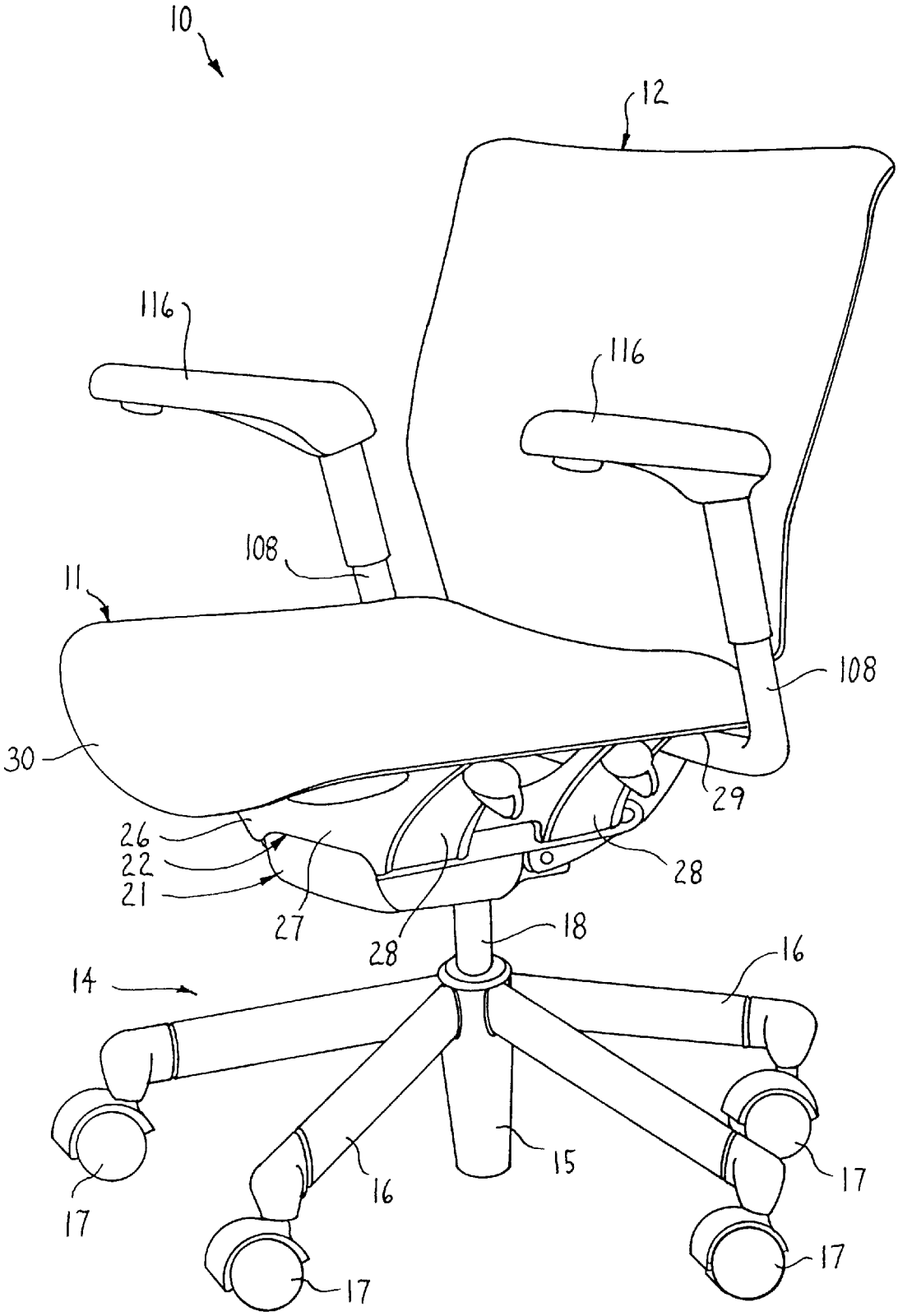
FIG. 1 is front perspective view of an office chair of the invention.

Certain terminology will be used in the following description for convenience in reference only, and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the arrangement and designated parts thereof. Said terminology will include the words specifically mentioned, derivatives thereof, and words of similar import.

DETAILED DESCRIPTION

Figure 2:
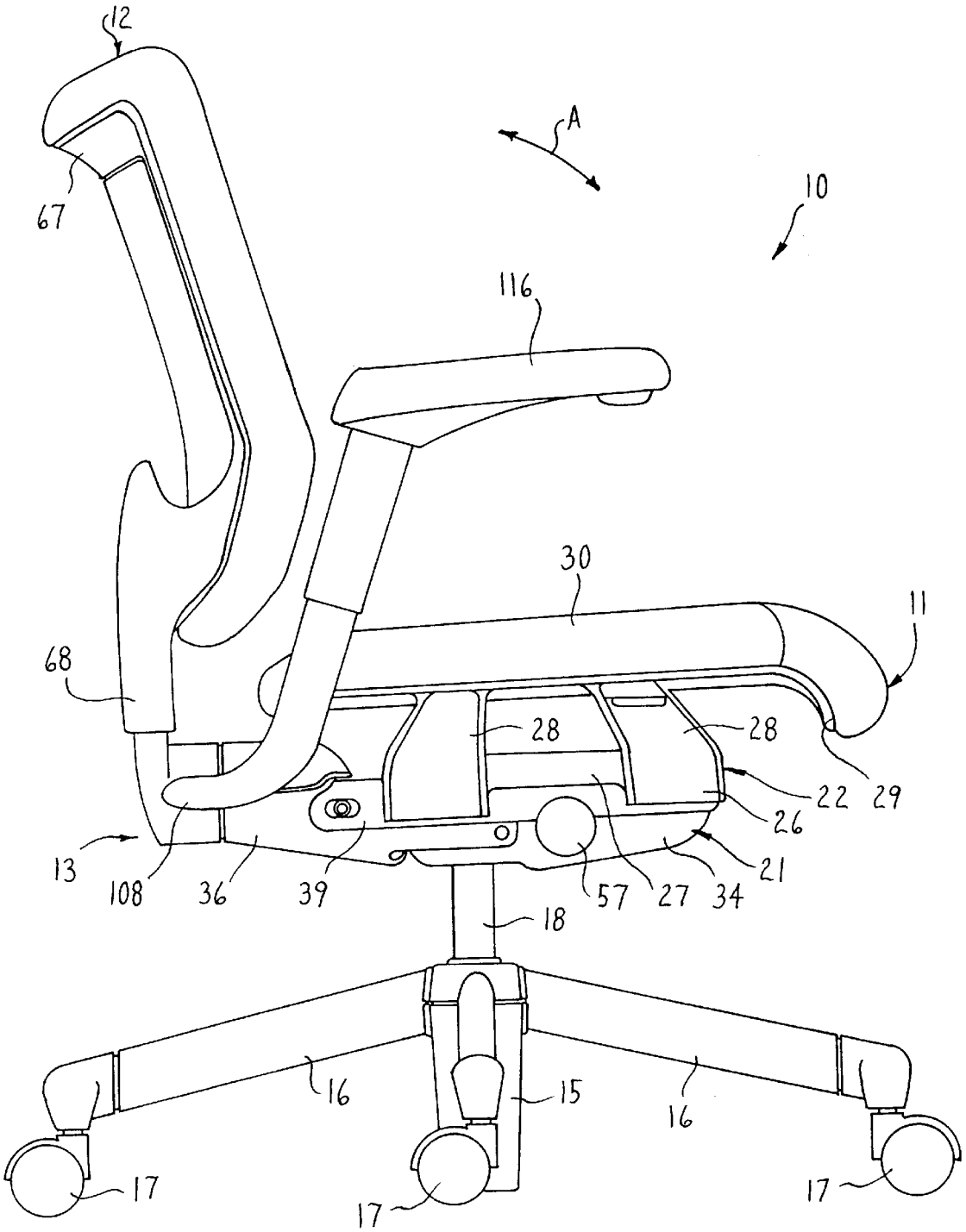
FIG. 2 is a side elevational view of the chair.
Figure 3:
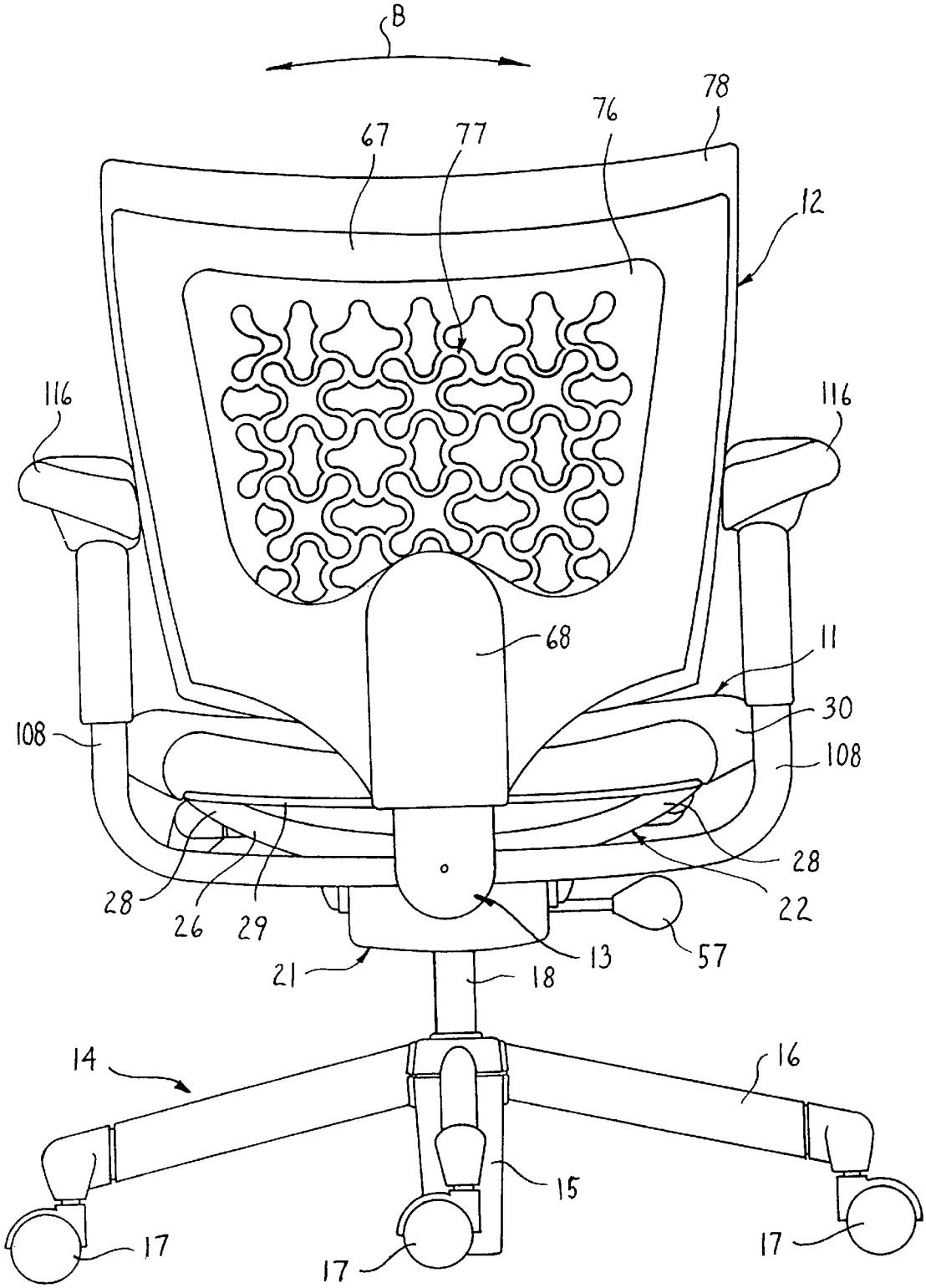
FIG. 3 is a rear elevational view of the chair.

Referring to FIGS. 1–3, the invention relates to an office-type chair 10 which includes a seat assembly 11 and back assembly 12 which are pivotally supported on a chair base or pedestal 14 to support a user thereon. To increase the comfort of the user, the seat assembly 11 is tiltable forwardly and rearwardly in the direction of arrow A (FIG. 2) by way of a tilt control mechanism 21 while the back assembly 12 thereof is tiltable laterally from side to side, i.e. in the leftward and rightward directions as indicated by reference arrow B (FIG. 3) by a back torsion mechanism 13.

Generally with respect to the main components of the chair 10, the base 14 is adapted to be supported on a floor and the seat assembly 11 is mounted to the base 14 by a tilt control mechanism 21. The tilt control mechanism 21 thereby permits forward and rearward tilting of the seat assembly 11 relative to the base 14, which tilting is conventional. Further, the inventive chair 10 includes the back torsion mechanism 13 which joins the back assembly 12 to the seat assembly 11. The back torsion mechanism 13 thereby provides a rigid connection therebetween such that the back assembly 12 pivots rearwardly in response to rearward tilting of the seat assembly 11. At the same time, the back torsion mechanism 13 also defines a forwardly extending horizontal pivot axis whereby the back assembly 12 can be pivoted to the left and right sides. This combination of forward-rearward tilting and torsional movement thereby provides three-dimensional chair movement to increase the comfort of a user.

More particularly, the chair base 14 includes a central hub 15 and a plurality of pedestal legs 16 which project radially outwardly therefrom. The ends of the pedestal legs 16 include casters 17 which are of conventional construction and support the chair 10 on a floor.

Further, the hub 15 supports an elongate cylindrical spindle 18 which is vertically movable so as to permit adjustment of the height of the chair 10. The spindle 19 is a rigid upright tube wherein the upper end of the spindle 18 supports a bottom of the seat assembly 11 thereon.

Generally, the seat assembly 11 includes the tilt control assembly 21 which is supported on the upper end of the spindle 18 and provides for forward and rearward tilting of the chair 10. The seat assembly 11 further includes a cushion assembly 22 which is supported on the tilt control mechanism 21 and supports the seat of a user.

The cushion assembly 22 includes a seat support frame 26 which mounts to the tilt control mechanism 21. In particular, the cushion support frame 26 includes a rectangular center mounting structure 27 which includes a downwardly depending peripheral side wall that is adapted to be fitted over the top of the tilt control mechanism 21. The center mounting structure 27 is secured to the top of the control mechanism 21 by suitable fasteners.

The seat support frame 26 further includes four support arms 28 which project sidewardly away from the left and right sides of the center mounting structure 27 and extend generally upwardly to support a ring-like ring-like rim 29 a predetermined distance above the control mechanism 21. The ring-like rim 29 has a generally annular shape and is open in the central region above the seat pan 27. The peripheral rim 29 is adapted to support a horizontally enlarged plastic inner shell (not illustrated) which overlies the open area of the peripheral rim 29 and includes a resiliently flexible membrane in the central region thereof to provide support to a seat cushion 30 which is attached thereto. The construction of the seat and back assemblies 11 and 12 is disclosed in U.S. patent application Ser. No. 08/846,616, entitled MEMBRANE CHAIR, filed concurrently herewith (Atty Ref: Haworth Case 215). The disclosure of this latter application, in its entirety, is incorporated herein by reference.

Figure 4:
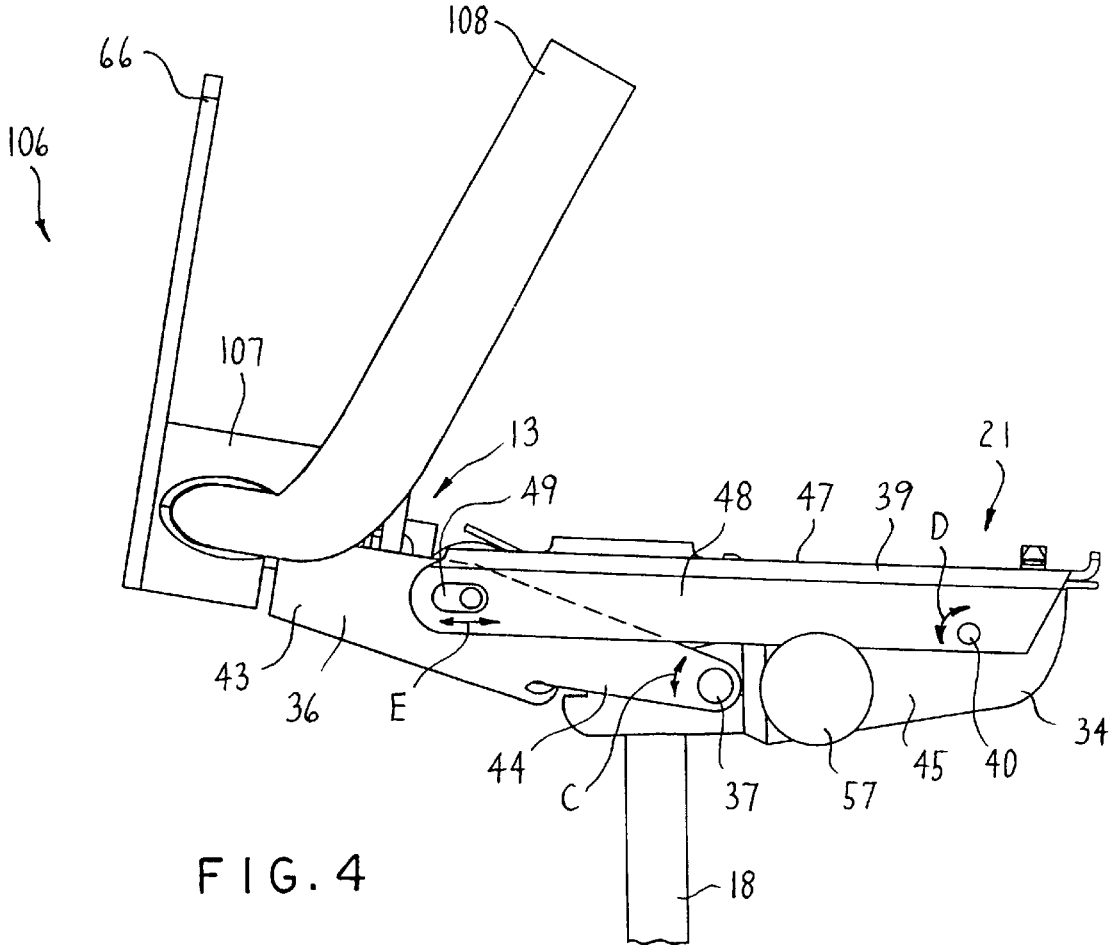
FIG. 4 is a partial side elevational view of a tilt control mechanism and upright assembly of the chair.
Figure 5:
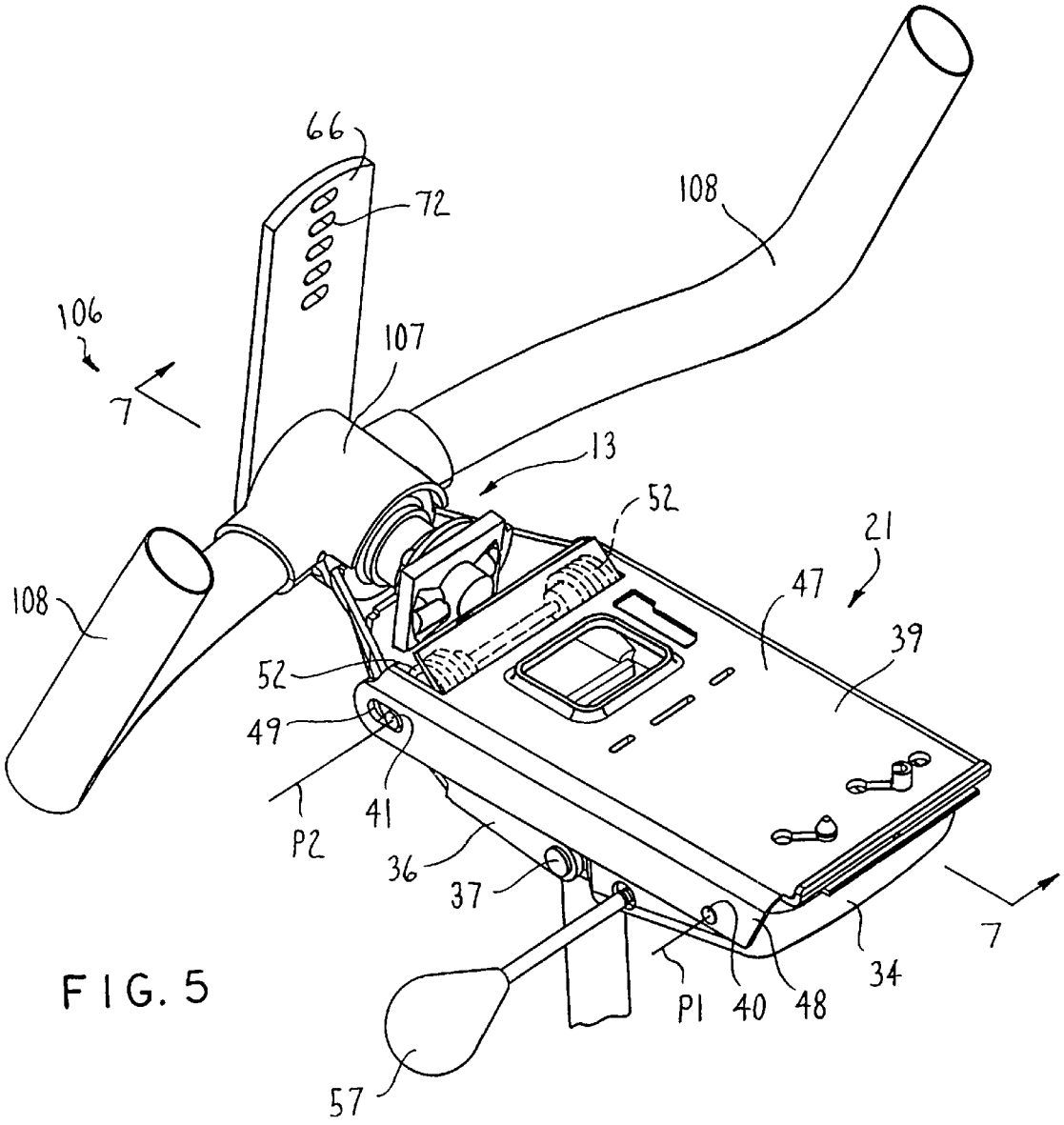
FIG. 5 is an isometric view of the tilt control mechanism and upright assembly.
Figure 6:
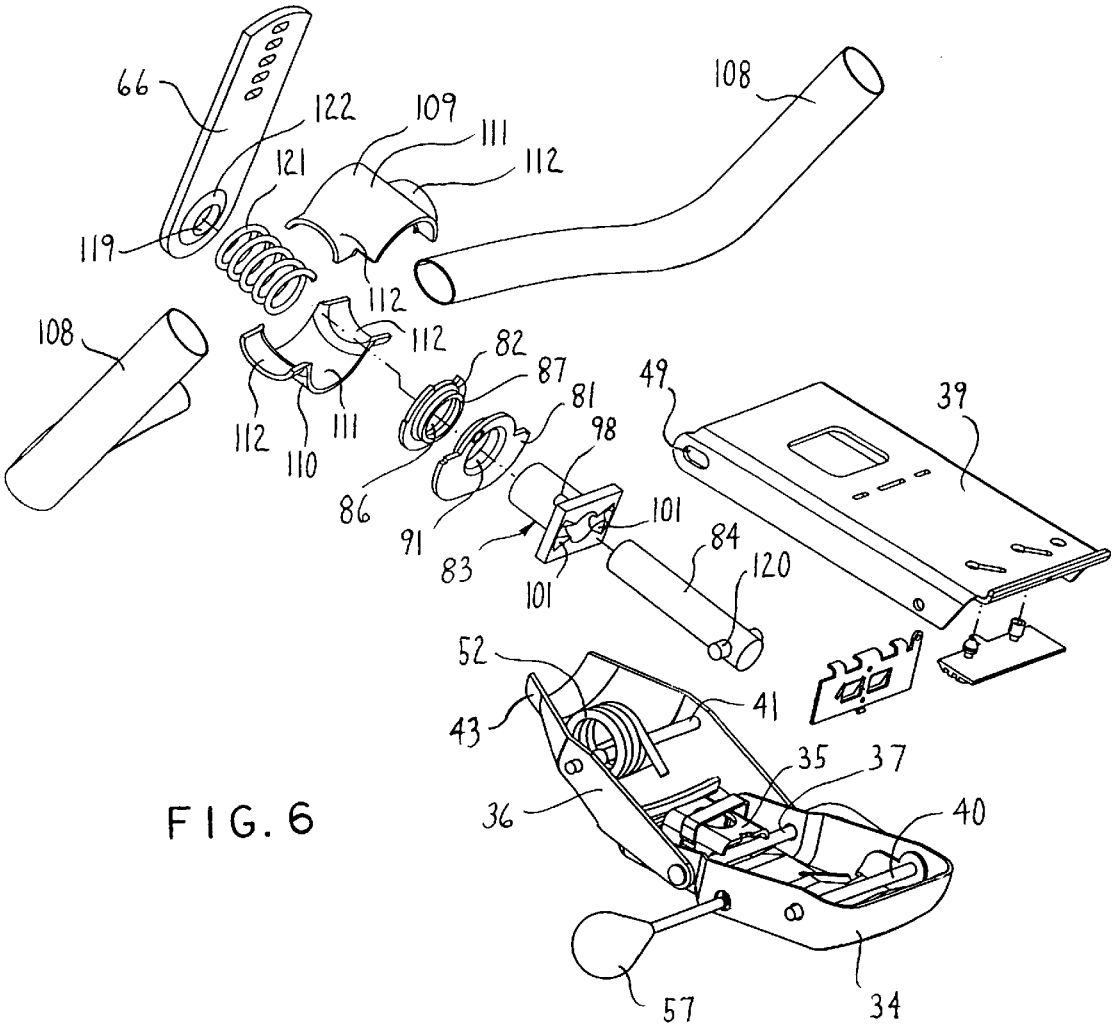
FIG. 6 is an exploded view of the components of FIG. 5.

Generally with respect to the tilt control mechanism 21, these types of mechanisms are used to mount a seat assembly to a chair base and permit rearward tilting of the chair relative to the base. Referring to FIGS. 4–6, the particular tilt control mechanism 21 generally disclosed herein permits both rearward tilting of the seat 11 relative to the base 14 about a first horizontal pivot axis P1 (FIG. 5) while also permitting a corresponding rearward tilting of the back assembly 12 relative to the seat about a second horizontal pivot axis P2. Preferably the tilting of the back assembly 12 about axis P2 is at a different and preferably greater rate than the rearward tilting of the seat 11 about axis P1 which arrangement is commonly referred to as a "synchro-tilt" mechanism. The tilt control mechanism 21 also permits limited forward tilting of the seat 11 relative to the base 14 to further optimize the comfort of a user. The construction of the tilt control mechanism 21 is disclosed in U.S. patent application Ser. No. 08/846,618, entitled TILT CONTROL FOR CHAIR, filed concurrently herewith (Atty Ref: Haworth Case 217). The disclosure of this latter application, in its entirety, is incorporated herein by reference.

More particularly, the tilt control mechanism 21 includes a box-like control housing 34 which is rigidly secured to the base 14 and opens upwardly to define a hollow interior. The hollow interior contains the internal components of the tilt control mechanism as described in more detail hereinafter. Generally, the interior of the control housing 34 includes a pedestal mounting bracket 35 proximate the rear edge thereof which mounts the control housing 34 to the upper end of the spindle 18. Preferably, the pedestal mounting bracket 35 permits swivelling of the chair 10 about a vertical axis.

The control mechanism 21 effectively defines a linkage which causes the synchronous tilting of the seat and back assemblies 11 and 12. In particular, the control mechanism 21 also includes a seat back support member 36 which is hinged to the control housing 34 by a center or intermediate pivot rod 37. The center pivot rod 37 defines the second horizontal pivot axis P2 which extends sidewardly so as to permit vertical swinging of the back support member 36.

The control mechanism 21 further includes a top plate 39 which has a front edge pivotally secured to the front of the control housing 34 by a front pivot rod 40, and a rear edge portion slidably secured to the back support member 36 by a rear pivot rod 41. The front and rear pivot rods 40 and 41 also are oriented horizontally and extend sidewardly, and the front pivot rod 40 defines the first pivot axis P1 about which the top plate 39 pivots. While the control housing remains stationary, the top plate 39 and back support member 36 thereby are joined one with the other so as to pivot downwardly together during rearward tilting of the chair 10.

To support the back assembly 12 on the control housing 34, the back support member 36 includes an upward-opening rearward end section 43 to which the back assembly 12 is connected as will be discussed in more detail hereinafter. The back support member 36 also includes a pair of pivot arms 44 which project forwardly from the rearward end section 43 and are pivotally secured to the side walls 45 of the control housing 34 by the center pivot rod 37. In particular, the center pivot rod 37 extends sidewardly or laterally through aligned apertures formed in the side walls 45 and pivot arms 45, and defines the first horizontal pivot axis P1 such that the back support member 36 is movable vertically generally in the direction of reference arrows C (FIG. 4).

The top plate 39 includes a horizontal top wall 47 and downwardly extending side walls 48 so as to seat over the control housing 34 and a portion of the back support member 36. The front section of the side walls 48 is secured to the side walls 45 of the housing 34 by the front pivot rod 40 which permits vertical pivoting of the top plate 39 generally in the direction of reference arrow D (FIG. 4) about the pivot axis P1. This vertical pivoting of the top plate 39 permits corresponding tilting of the seat assembly 11 which projects upwardly therefrom.

The rear section of the side walls 48 of the top plate 39 also includes horizontally elongate slots 39 through which the rear pivot rod 41 projects. Thus, unlike the center and front pivot rods 37 and 40 respectively, the rear pivot rod 41 is slidable along the slots 49 generally in the direction of reference arrow E (FIG. 4) such that vertical pivoting of the top plate 39 about axis P1 causes a corresponding vertical pivoting of the back support member 36 about axis P2. This vertical pivoting of the back support member 36 thereby results in the forward and rearward tilting of the back assembly 12 which projects upwardly therefrom.

To normally maintain the back assembly 12 in a generally vertical upright position as seen in FIGS. 1–3, the control mechanism 21 also includes a front coil spring 51 (FIG. 7) which is supported on the front pivot rod 40, and a pair of rear coil springs 52 which are supported on the rear pivot rod 41.

The front coil spring 51 includes an upper leg 53 which acts upwardly on the top plate 39, and a lower leg 54 which acts downwardly on the bottom wall of the control housing 34 so as to thereby normally urge the top plate 39 upwardly. The back assembly 12 thereby is urged forwardly to its upright position due to the connection of the top plate 39 with the back support member 36. The tension being applied by the front coil spring 51 is adjusted by a wedge-block tension adjustment mechanism 56. The tension adjustment mechanism is manually actuated by a tension adjustment handle 57 (FIG. 6) which projects laterally through the side wall 45 of the control housing 34.

Figure 7:
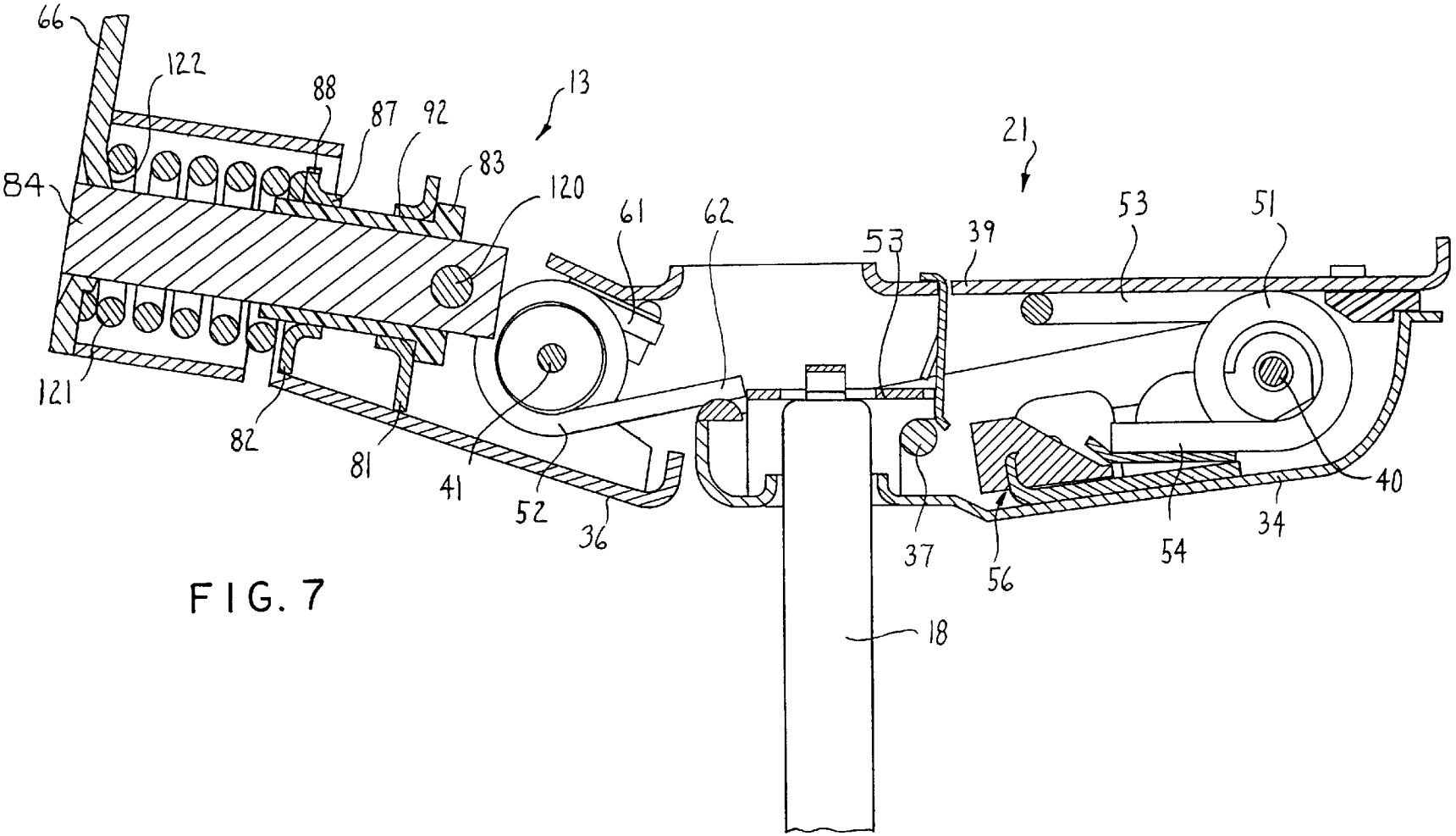
FIG. 7 is a partial side elevational view in cross section of the tilt control mechanism and the upright assembly as viewed in the direction of arrows 7—7 in FIG. 5.

As seen in FIG. 7, the rear coil spring 52 also urges the top plate 39 upwardly so as to assist the front spring 51. In particular, the rear spring 52 includes an upper leg 61 which acts upwardly on the top plate 39, and a lower leg 62 which is supported on a rear edge of the control housing 34 so as to act downwardly thereon. The front and rear coil springs 51 and 52 thereby combine to urge the top plate 39 upwardly and tend to maintain the back assembly 12 vertically upright member. It will be readily understood by the skilled artisan that other tilt control mechanisms can be provided so as to permit forward and rearward tilting of the seat assembly 11 without departing from the invention disclosed herein with respect to the back torsion mechanism 13.

To permit the torsional or lateral movement of the back assembly 12 in combination with the forward and rearward tilting of the seat assembly 11, the back torsion mechanism 13 connects a vertical upright member 66 (FIG. 7) of the back assembly 12 to the back support member 36 of the tilt control mechanism 21. Generally with respect to the back assembly 12, the upright member 66 supports a back frame 67 (FIG. 3) on which the back of a user is supported. The back torsion mechanism 13 thereby permits left and right sideward or lateral tilting of the back assembly 12 relative to the seat assembly 13 in the direction of arrow B (FIG. 3).

Referring to FIGS. 3 and 7, the back frame 67 includes a lower hub 68 which has an interior pocket 69 (FIG. 7) in which is received a back height adjustment mechanism 71. The back height adjustment mechanism 71 is diagrammatically illustrated in FIG. 5 in engagement with the upper end of the upright member 66, and permits vertical adjustment of the overall height of the back frame 67 relative to the seat assembly 11. The back height adjustment mechanism 71 preferably is a separable cartridge which is slidably received in the pocket 69 and connected to the upper end of the upright member 66. One example of a suitable back height adjustment mechanism 71 is disclosed in U.S. Pat. No. 4, 639,039, the disclosure of which, in its entirety, is incorporated herein by reference.

Alternatively, the back height adjustment mechanism 71 may include a ratchet-like mechanism (not illustrated) which engages the apertures 72 formed in the upright member 66 wherein the ratchet-like mechanism engages the apertures 72 as the back frame 67 is raised. A release mechanism is provided so as to release this ratchet-like mechanism and permit lowering of the back frame 67. A more detailed disclosure with respect to the back height adjustment mechanism 71 is not believed necessary for an understanding of the back torsion mechanism 13 which is discussed in more detail hereinafter.

Similar to the seat assembly 11, the back assembly 12 (FIG. 3) also includes a plastic inner shell 76 which is fixedly mounted to the back frame 67 and includes a resiliently flexible membrane 77 which is located in the open central area of the back frame 67 and accommodates the contours of a user. The inner shell 76 is covered by a cushion 78 that defines a bach surface.

More particularly with respect to the back torsion mechanism 13, this mechanism joins the back assembly 12 to the seat assembly 11.

Referring to FIGS. 6 and 7, the back torsion mechanism 13 generally includes a pair of mounting plates 81 and 82 which are welded into the rearward end section of the back support member 36 to provide a mounting location for the back assembly 12. These mounting plates 81 and 82 support a hollow cylindrical bearing 83 therethrough which in turn supports a shaft 83 projecting forwardly from the upright member 66.

Figure 8:
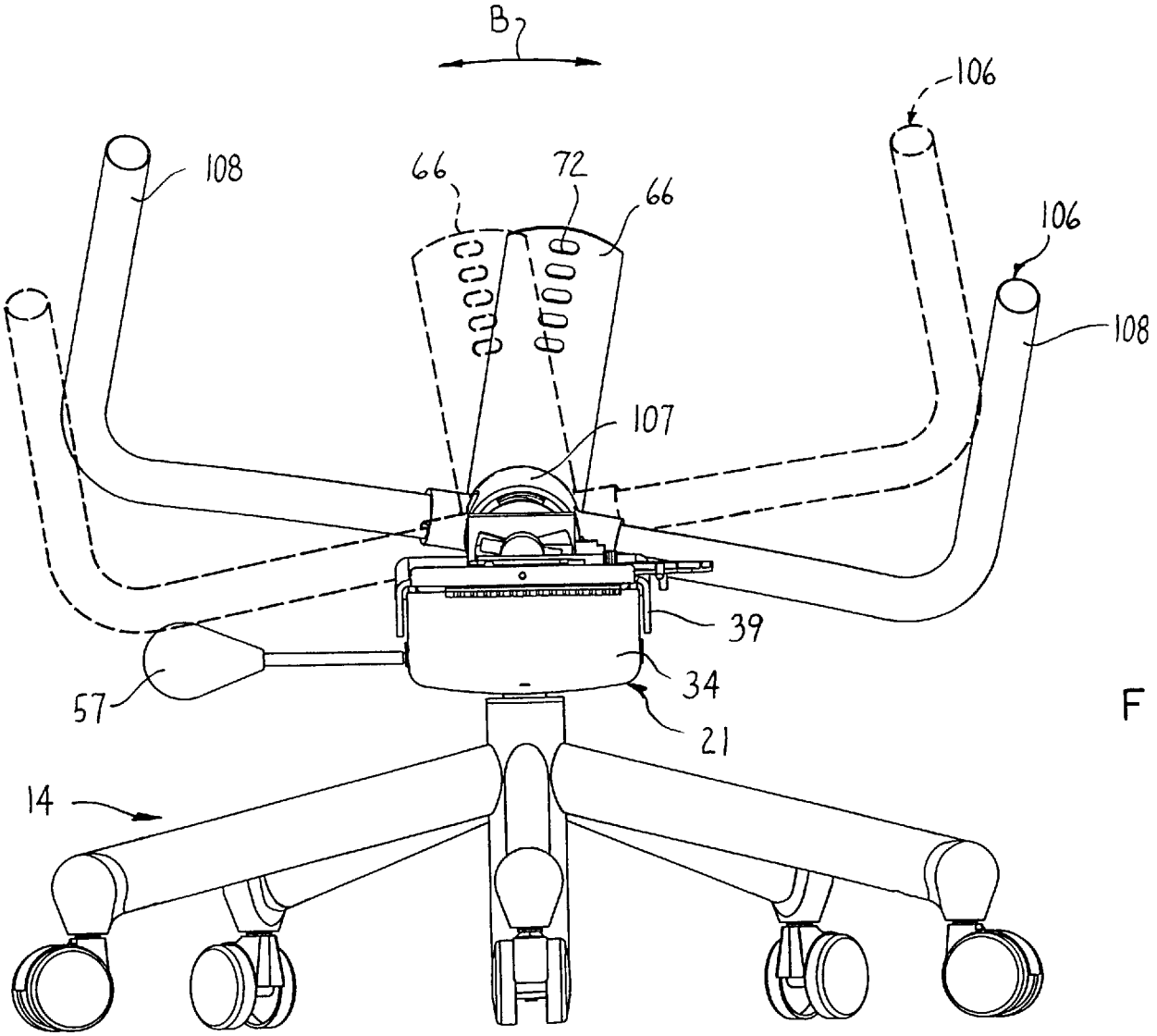
FIG. 8 is a partial front elevational view of the chair.

One end of the shaft 84 is rigidly welded to a lower end of the upright member 66 while the other forward end of the shaft 84 is slidably inserted into the bearing 83 so that the upright member 66 and thereby the back assembly 12 are sidewardly movable relative to the mounting plates 81 and 82. This sideward torsional movement is diagrammatically illustrated in FIG. 8 which illustrates alternative locations for the chair 10 having most of the seat assembly 11 and back assembly 12 removed therefrom. As will be discussed in more detail hereinafter, the back torsion mechanism 13 also includes self-centering means which normally maintains the upright member 66 in the vertical central position illustrated in FIGS. 1–3 while permitting reversible sideward movement of the upright member 66 to the rightward position illustrated in solid outline in FIG. 8 and the leftward position illustrated in phantom outline therein.

Figure 9:
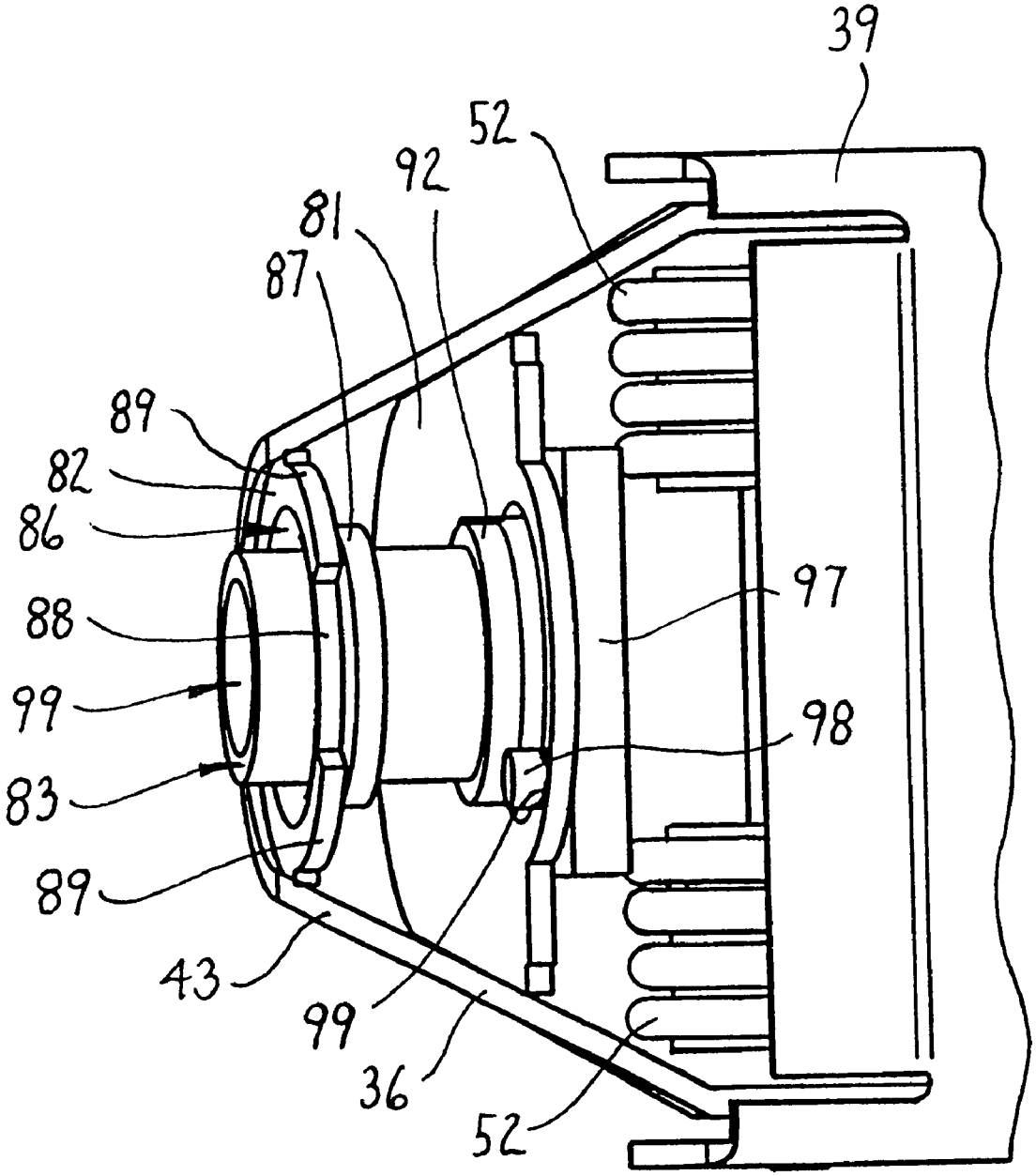
FIG. 9 is partial top plan view of the tilt control mechanism.

Referring to FIGS. 6, 7 and 9, the outer mounting plate 82 generally has a disc-like shape, the bottom half of which is adapted to be seated near the end edge of the back support member 36. This outer mounting plate 82 is welded in place so as to extend upwardly from the bottom of the back support member 36. The outer mounting plate 82 is formed with a central opening 86 which opens forwardly or horizontally therethrough, and an annular lip 87 which projects forwardly so as to have a generally cylindrical shape. The central opening 86 and lip 87 are adapted to receive the bearing 83 therethrough as will be discussed in more detail hereinafter.

The upper half of the outer mounting plate 82 also includes a central notch or opening 88 which is provided for locking of the torsional movement of the back assembly 12. On the opposite sides of the notch 88, the outer mounting plate 82 further includes circumferentially extending grooves 89 which are provided to limit the amount of torsional movement of the back assembly 12.

The inner mounting plate 81 is formed somewhat similar to the outer mounting plate 82 in that the lower section thereof is adapted to be inserted into the back support member 36 and welded in place. The inner mounting plate 81 thereby projects upwardly and is oriented generally parallel with respect to the outer mounting plate 82 on a front side thereof.

The inner mounting plate 81 also includes a central aperture 91 which opens horizontally therethrough and is aligned coaxially with respect to the opening 86 of the outer mounting plate 82. An annular lip 92 circumscribes this aperture 91 and projects rearwardly toward the outer mounting plate 82. To prevent rotation of the bearing 83 when mounted in the inner and outer mounting plates 81 and 82, the inner mounting plate 81 further includes a pair of relatively small holes 93 extending horizontally therethrough, one of which is illustrated just above the aperture 91 in FIG. 10.

The bearing 83 is inserted through the aligned apertures 86 and 91 of the inner and outer mounting plates 81 and 82 respectively, and supports the shaft 84 to reduce the friction associated with torsional movement of the back assembly 12. In particular, the bearing 83 includes a hollow cylindrical section 96 which is slid through the aligned apertures 86 and 91 so as to effectively be supported by the inner and outer mounting plates 81 and 82. The annular lips 87 and 92 of these plates 81 and 82 increase the circumferential surface area of the cylindrical bearing section 96 which is being supported thereby.

The forwardmost end of the cylindrical section 96 is formed with a rectangular bearing block 97, the edges of which project radially outwardly from the outer circumferential surface of the cylindrical section 96. The bearing block 97 is adapted to abut against the forward facing surface of the inner mounting plate 81 so as to locate the bearing 83 in the apertures 86 and 91. Further, the bearing block 97 is formed integrally with a pair of pins 98 located at the opposite diagonal corners thereof. The pins 98 project rearwardly and are adapted to be slid into the corresponding holes 93 formed in the inner mounting plate 81. The pins 98 serve to orient the bearing block 97 as will be discussed in more detail and also serve to prevent rotation of the bearing 83.

Preferably, the bearing 83 is formed of a low-friction material such as nylon or other similar plastic.

To support the shaft 84, the bearing 83 includes a longitudinal bore 99 which extends entirely therethrough and slidably receives the shaft 84 therein. The diameter of the bore 99 preferably is closely approximate to the outside diameter of the shaft 84 so that little, if any, play is provided therebetween while at the same time permitting rotation of the shaft 84 relative to the bore 99. Once the shaft 84 is received in the bore 99, the upright member 66 effectively is rigidly supported on the back support member 36 so as to tilt therewith. At the same time, the upright member 66 is laterally movable or rotatable about a horizontal pivot axis P3 defined by the bearing 83 and shaft 84. Preferably, this third pivot axis P3 extends forwardly and is located below the seat of a user to permit sideward movement of the user's entire back. As a result, the user bends sidewardly in the region of their hips.

While the back assembly 12 is laterally movable, the back torsion control mechanism 13 preferably includes self-centering means for normally urging the back assembly to the normal upright position as seen in FIGS. 1–3. Accordingly, the forward face of the bearing block 97 includes a pair of camming grooves 101 which extend radially outwardly to the left and right sides of the bore 99. These camming grooves 101 form a portion of the centering means discussed above.

Figure 10:
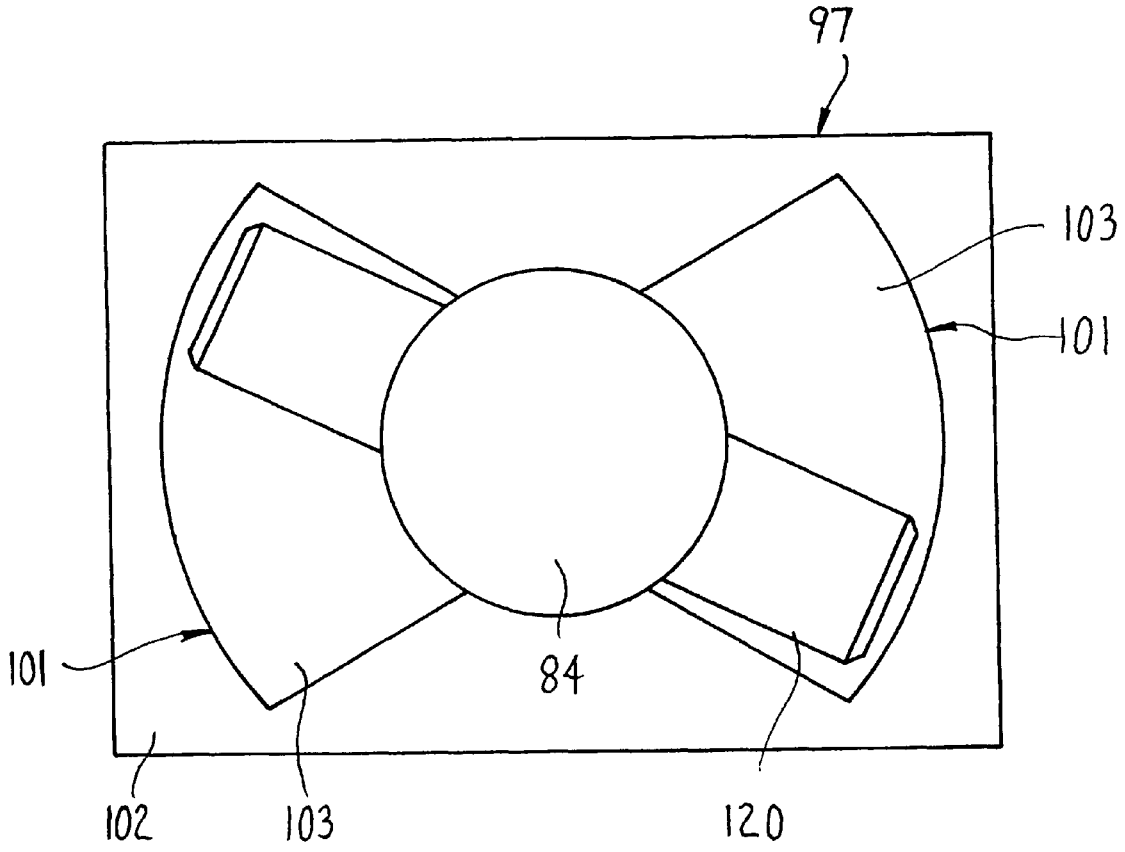
FIG. 10 is a front elevational view of a bearing block of the tilt control mechanism.
Figure 11:
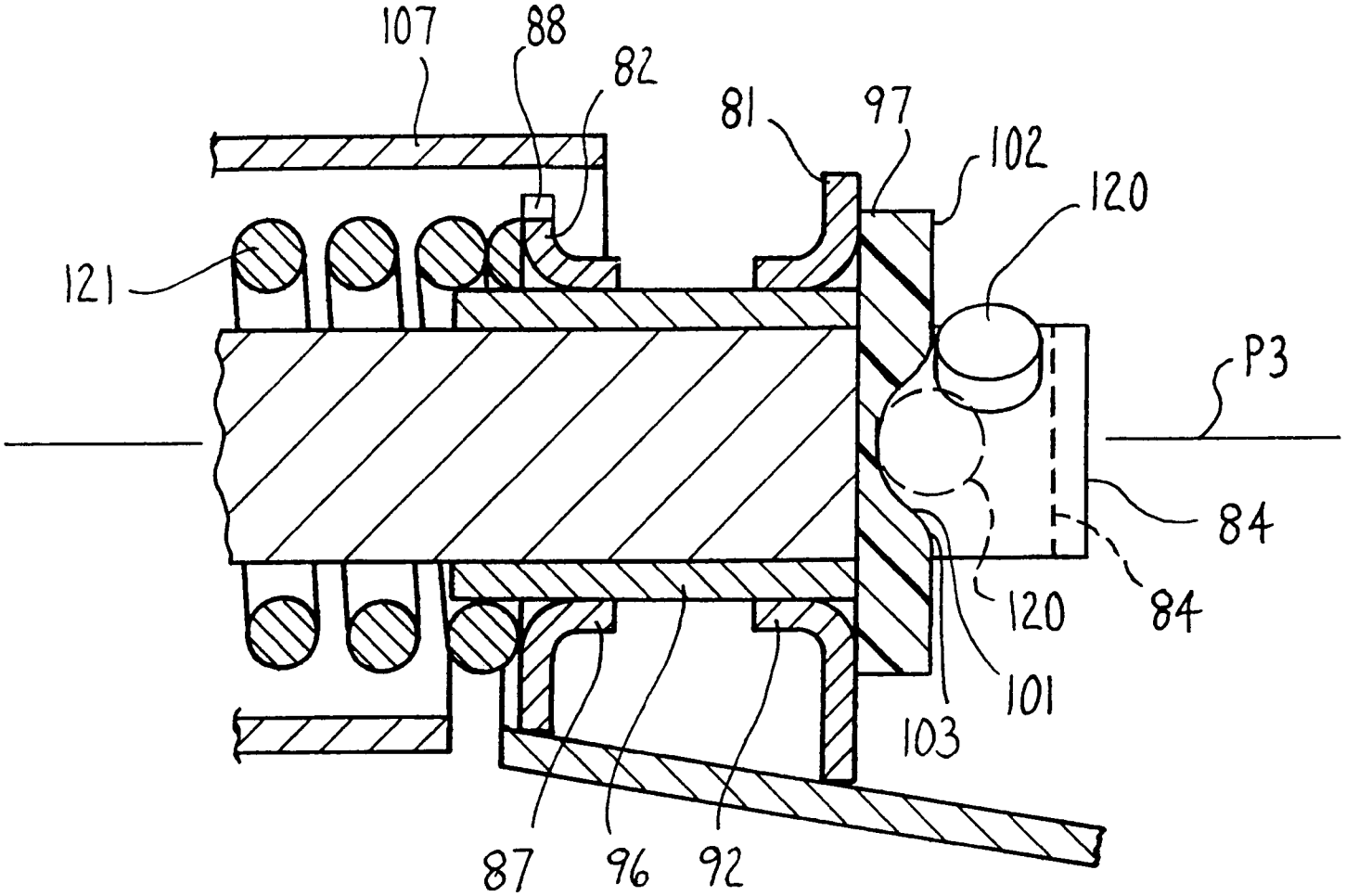
FIG. 11 is a partial side elevational view in cross section of the tilt control mechanism.

More particularly with respect to FIGS. 10 and 11, the bearing block 97 preferably has a front flat planar surface 102 which is recessed on the opposite left and right sides of the bore 99 so as to form these camming grooves 101. Preferably, each of the camming grooves 101 extends circumferentially an angular distance. Referring to FIG. 11, the camming grooves 101 are formed with an arcuate bearing surface 103 which curves rearwardly into the bearing block 97. The operation and function of these camming grooves 101 are described in more detail herein with respect to the following discussion of the shaft 84.

Figure 12:
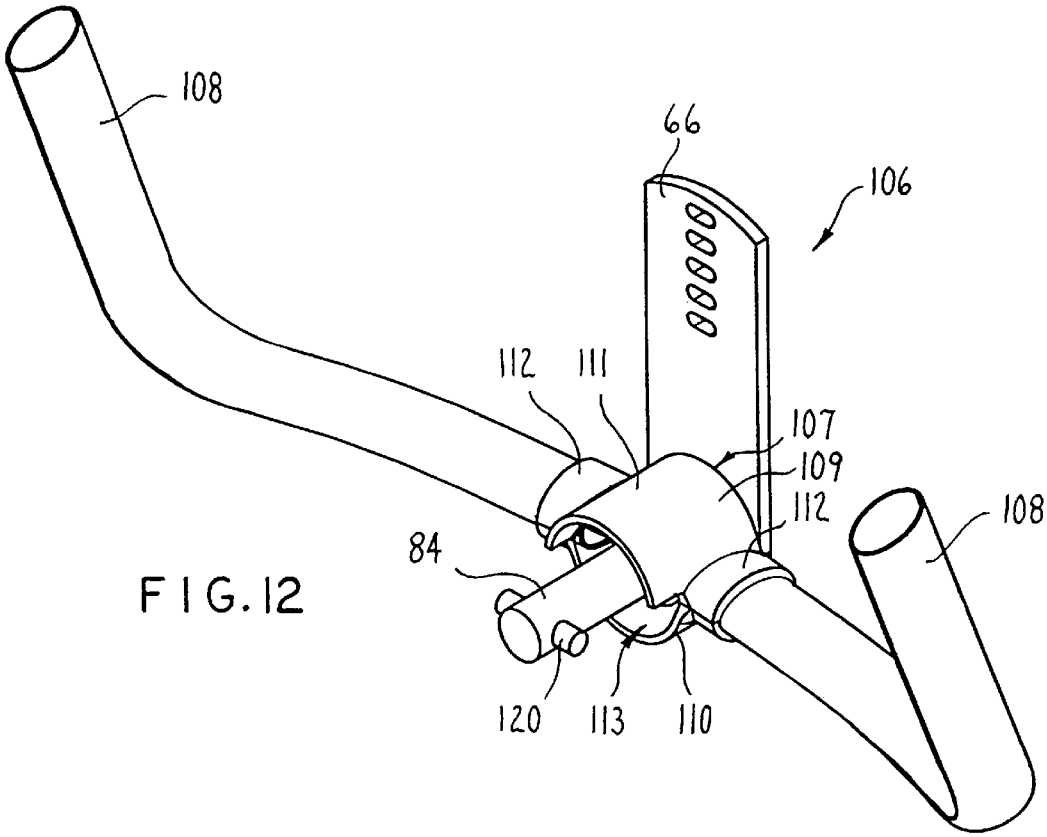
FIG. 12 is a perspective view of the upright assembly.
Figure 13:
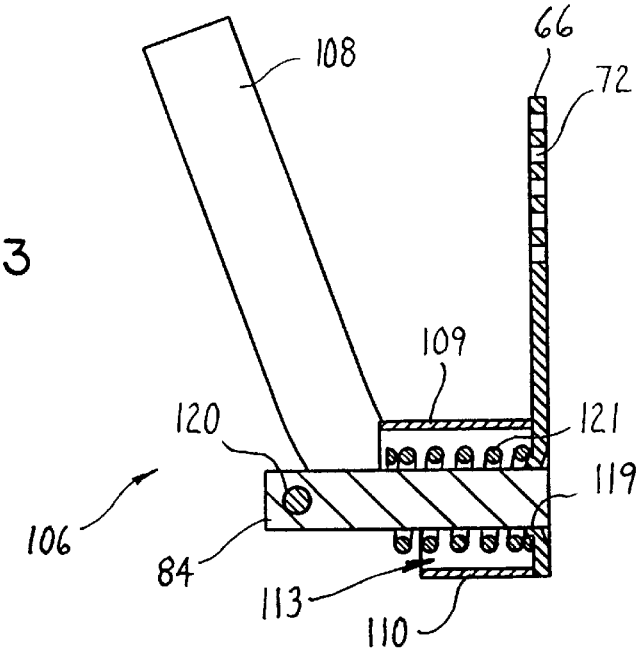
FIG. 13 is a side elevational view in cross section of the upright assembly.

More particularly with respect to the connection of the upright member 66, the upright member 66 preferably forms part of an upright assembly 106 as seen in FIGS. 12 and 13. In particular, the upright assembly 106 not only includes the upright member 66, but further includes the shaft 84 welded thereto, an outer shroud 107 and a pair of arm support tubes 108 which are connected to the outer shroud 107.

Figure 14:
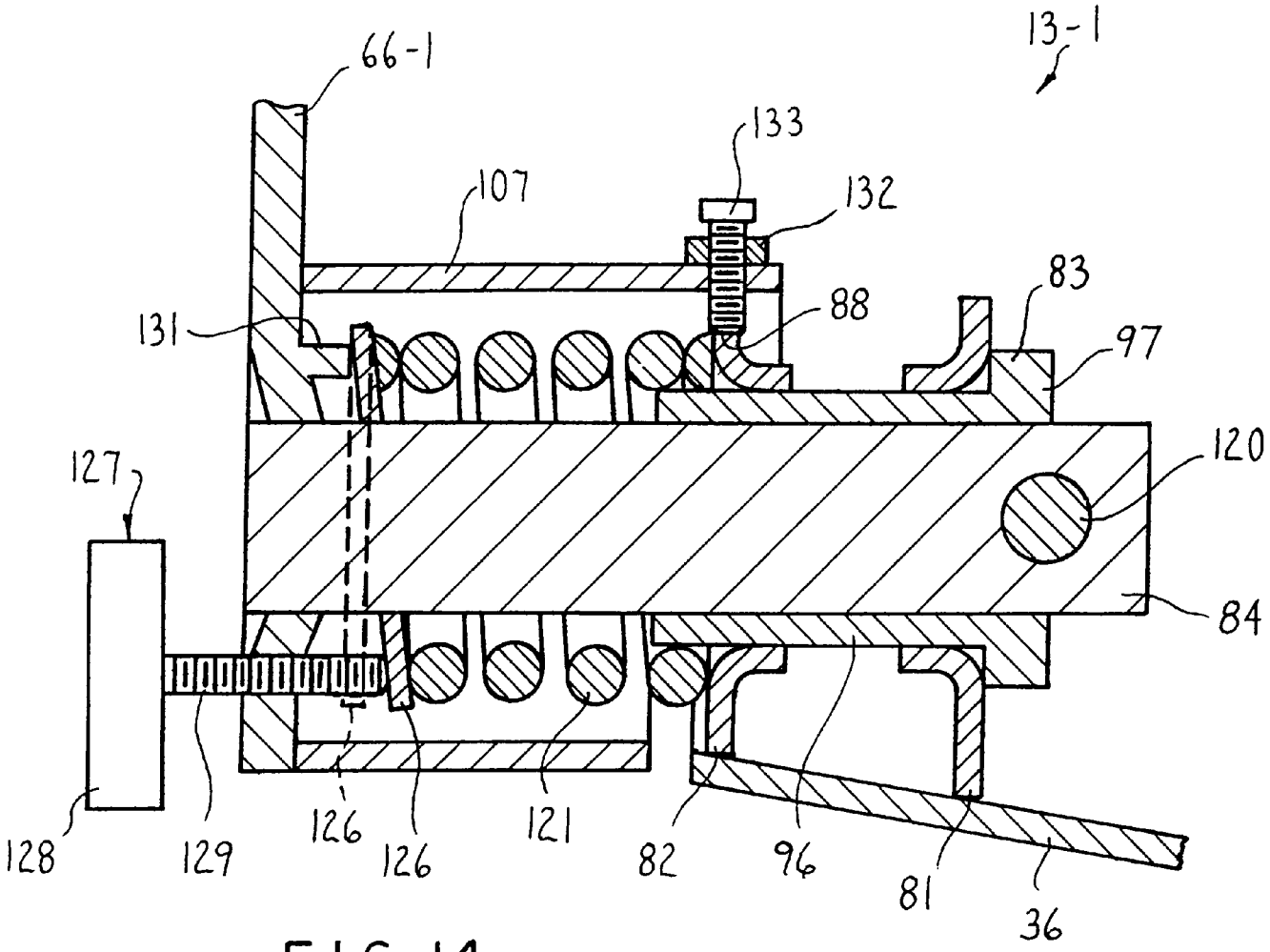
FIG. 14 is a side elevational view in cross section of a second embodiment of the invention.

To cover a portion of the back torsion mechanism 13, upper and lower cover plates 109 and 110 (FIGS. 6, 7, 12 and 13) are formed identical to each other and are mated together. In particular, each of the cover plates 109 and 110 includes a semi-circular central section 91 and a pair of semi-circular arm support sections 112 which project sidewardly from the central section 111. The upper and lower cover plates 109 and 110 are placed in an opposing relation and then welded together to define the outer shroud 107 which is open on the opposite ends thereof. Then, the mated cover plates 109 and 110 are welded to the upright member 66 so as to project forwardly therefrom. When the cover plates 109 and 110 are welded in place as seen in FIG. 14, a hollow cylindrical spring cavity 113 is formed by the central sections 91 which opens forwardly toward the tilt control mechanism 21.

Further, when the semi-circular arm support sections 112 are mated together, a pair of arm sockets 114 are formed on the opposite sides of the spring cavity 113 which are adapted to receive corresponding ends of the arm support tubes 108 therein. The arm support tubes 108 are welded into these arm sockets 114 such that the pair of arms are fixedly supported on the upright assembly 106. The upper ends of the arm support tubes 108 further include suitable arm rests 116 which are connected to the open upper ends of the support tubes 108 and preferably are height-adjustable.

The rearward end of the shaft 84 also is supported on the upright assembly 106. The shaft 84 preferably is a cylindrical metal shaft which has a rearward end inserted into an opening 119 formed in the lower end of the upright member 66 and thereafter is welded in place. Thus, the shaft 84 projects through and out of the spring cavity 113 so that the forward end of the shaft 84 is engagable with the bearing 83.

The shaft 84 slides into the bore 99 of the bearing 83 such that the entire upright assembly 106 is pivotable relative to the seat assembly 11. To prevent disengagement of the shaft 84 from the bearing 83, the forward end of the shaft 84 includes a sidewardly extending bore therethrough and a transverse pin 120 seated therein. As can be seen in FIGS. 6, 11 and 12, the transverse pin 120 projects radially outwardly from the opposite sides of the shaft 84 and seats within the camming grooves 101 of the bearing block 97.

The upright assembly 106 further includes a coil spring 121 which is slid over the shaft 84 as seen in FIG. 13 prior to engagement of the shaft 84 with the bearing 83. The spring 121 is a compression spring which is contained within the spring cavity 113 of the outer shroud 107. As seen in FIG. 7, the leftward end of the spring 121 acts directly upon the upright member 66 while the rightward end thereof acts forwardly upon the outer mounting plate 82. To facilitate alignment of the spring 121 relative to the shaft 84, the upright member 66 is formed with a forwardly projecting conical surface 122 while at the same time the bearing 83 has a rearward end which projects rearwardly through the outer mounting plate 82. The spring 121 is mounted in compression to thereby act upon the upright member 66 and urge the upright member 66 and the attached shaft 84 leftwardly or away from the inner and outer mounting plates 81 and 82. By urging the shaft 84 leftwardly or rearwardly as seen in FIG. 11, the transverse pin 120 is drawn into the camming grooves 101 as generally illustrated in phantom outline. When the back assembly 12 is in the normal upright position, the transverse pin 120 is drawn to the deepest portion of the camming grooves 101 as illustrated in phantom outline.

However, upon rotation of the back assembly 12 by a user, the upright member 66 thereby rotates the shaft 84 in either the clockwise or counter-clockwise directions which thereby causes sliding of the transverse pin 120 along the bearing surface 103 of the camming grooves 101. Preferably, the angular displacement of the transverse pin 120 is approximately 10° in either the clockwise or counter-clockwise directions. Since the bearing surfaces 103 are arcuate, the transverse pin 120 has a forward component of motion as it slides therealong which thereby effects a forward movement of the shaft 84 as generally seen in FIG. 12. Since the shaft 84 moves forwardly in response to sliding of the transverse pin 120, the upright member 66 also moves forwardly a limited distance which serves to compress the spring 121. This increases the force being applied by the spring 121 upon the upright member which thereby tends to act against axial sliding of the shaft 84. Once the back assembly 12 is allowed to return to its normal upright position, the spring 121 tends to pull the transverse pin 120 back to its normal central location which is located at the deepest portion of the camming grooves 101 as seen in phantom outline. The spring 121 thereby effects a self-centering or automatic return of the upright member 66 to the normal vertical position. The spring 121, camming grooves 101 and the transverse pin 120 therefore tend to act together so as to define a self-centering means for the torsional control mechanism 13.

The spring 121 also can be chosen to limit the extent of the sideward movement which is permitted during normal use. In particular, as the back assembly 12 is tilted, the forces applied by the spring 121 increase preferably to the point where the resistance to tilting overcomes the normal tilting forces being applied by a user.

In view of the foregoing, the back assembly 12 is connected to the seat assembly 11 by the back torsion mechanism 13. This back torsion mechanism 13 permits lateral torsional movement of the back assembly 12 relative to the seat assembly 11 which increases the comfort of a user. Further, the back torsion mechanism 13 includes self-centering means which tends to urge or return the back assembly 12 to the normally upright position.

Also, since the arm support tubes 108 are rigidly secured to the outer shroud 107 which is rigidly secured to the upright member 66, the armrests 116 further assist in the movement of the back both leftwardly and rightwardly. These arm support tubes 108 tend to act as lever arms which allows a user to lean upon these arms and assist in the torsional movement of the back assembly 12. While the arm support tubes 108 need not be provided, the connection of the armrests 116 directly to the back assembly 12 is desirable since frictional gripping of the back onto the back rest cushion otherwise is necessary to effect the torsional movement of the back.

While the above-described embodiment for the back torsion mechanism 13 has the inner spring 121 in direct contact with the upright member 66, it is preferred that the back torsion mechanism 13 have tension adjustment means (FIG. 14) for adjusting or increasing the tension or the forces being applied by the spring 121 which thereby allows a user to adjust the force required to move the back assembly 12 to the left and right. Referring to FIG. 14, components which are identical to those discussed above are designated with the same reference numerals. For those components which have been modified, these modified components are designated with a "−1" in front of the reference numeral.

More particularly, the tension adjustment mechanism in the back torsion mechanism 13-1 preferably comprises an adjustment plate 126 which is seated between the spring 121 and the upright member 66 and is moved by a threaded adjustment knob 127 to move the plate and adjust the spring forces 121. The adjustment knob 127 projects rearwardly from the back assembly 12 so that a user can manually rotate the knob 127 as desired.

The adjustment knob 127 includes a hand knob 128 and a threaded shaft 129 which is threadingly engaged with the upright member 66-1 and projects therethrough into the spring cavity 113. The threaded shaft 129 abuts against a portion of the annular adjustment plate 126 so as to move the plate 126 forwardly to increase the forces as generally illustrated in solid outline in FIG. 15. The threaded shaft 129 also can be rotated and backed out axially to the left so as to allow the plate 126 to move rearwardly as generally seen in phantom outline.

To prevent binding of the adjustment plate 126 on the exterior surface of the shaft 84, a projection 131 preferably is provided on the upright member 66 which projects forwardly therefrom. The projection 131 is located on the side of the shaft 84 opposite the threaded shaft 129 such that the adjustment plate 126 pivots thereon. By manually rotating the hand knob 128, the threaded shaft 129 can be moved into and out of the spring cavity 113 so as to adjust the angle of the adjustment plate 126 and thereby increase or decrease the forces being applied by the spring 121.

It is also preferred that the back torsion mechanism 13-1 include a locking mechanism for preventing the torsional movement of the back assembly 12 if desired by a user. In one embodiment of the locking mechanism, a threaded nut 132 is welded to the outer shroud 1-107. A manually rotatable screw 133 is engaged with the nut 132 so that it can be driven radially into and out of the spring cavity 113. The screw 133 is positioned closely adjacent to the notch 88 formed in the outer mounting plate 82. By driving the screw 133 radially inwardly into the spring cavity 113, the inner end of the screw 133 seats within the notch 88 so as to prevent or limit torsional movement of the back assembly 12. Further, the screw 133 can serve as a stop to limit the extent of torsional movement. In particular, the screw 133 can be positioned just out of the notch 88 so as to permit torsional movement while still being positioned within the circumferentially-extending grooves 89 in the outer mounting plate 82. The end of the screw 133 thereby travels along these grooves 89 during torsional movement until contacting the edge of the grooves 89 and preventing further torsional movement of the back assembly 12. The screw 133 thereby can serve to limit the extent of travel.

Figure 15:
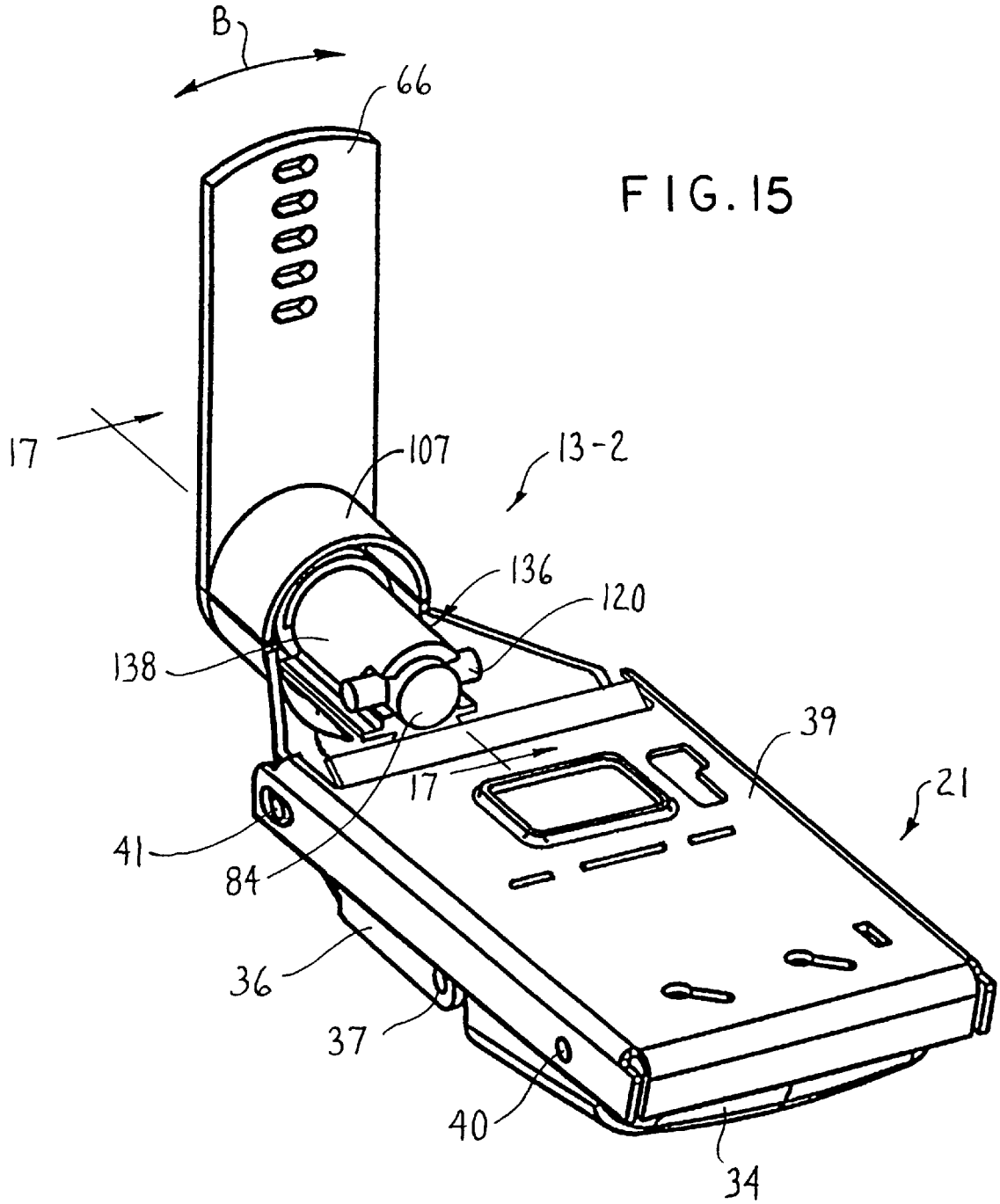
FIG. 15 is an isometric view of a third embodiment of the invention.
Figure 17:
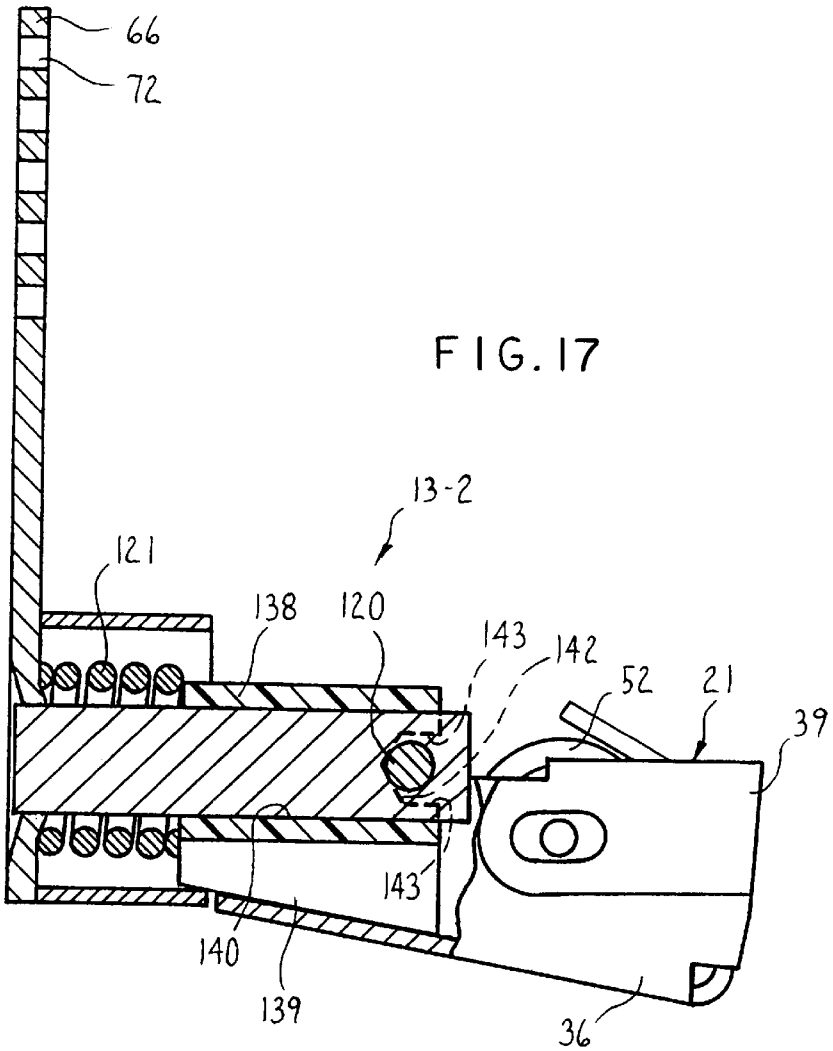
FIG. 17 is a side elevational view in cross section of the tilt control mechanism of the third embodiment as viewed in the direction of arrows 17—17 of FIG. 15.
Figure 16:
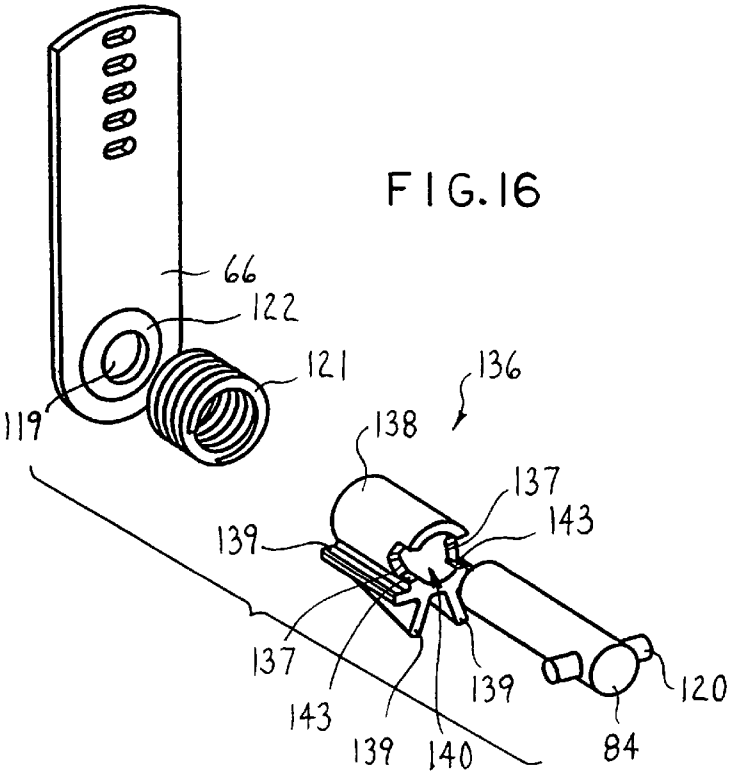
FIG. 16 is an exploded view of the third embodiment of FIG. 15.

Referring to FIGS. 15–17, a further embodiment of the back torsion mechanism 13-2 is illustrated. While the mounting plates 81 and 82 and bearing 83 are formed as separate components, these components may also be formed as a single powdered metal mounting bracket 136 which includes camming grooves 137. The bracket 136 thereby operates substantially the same as the first embodiment of the back torsion mechanism 13 described above.

More particularly, the mounting bracket includes a central cylindrical bearing section 138 which includes a plurality and preferably four fins 139 which extend radially outwardly therefrom. The mounting bracket 136 seats within the rear end section of the back support member 36 described above. The fins 139 thereafter are fixed in place by welding or the like.

The bearing section 137 also includes a central bore 140 which extends forwardly therethrough. The bore 140 slidably receives the shaft 84 therein like the above-described bore 99 so as to support the back assembly 12 while permitting lateral rotation thereof about the pivot axis P3.

A forward edge of the bearing section 136 also includes the camming grooves 137. The grooves 137 include an arcuate bearing surface 142 along which the transverse pin 120 of the shaft 84 slides. The grooves 137 also include axial stop surfaces 143 which extend forwardly away from the arcuate bearing surface 142. The stop surfaces 143 prevent further rotation of the back assembly 12 past this point to effectively define limits for clockwise and counterclockwise rotation of the back assembly 12.

While all of the above-described embodiments 13, 13-1 and 13-2 are illustrated for use with a chair having a two-piece inner shell arrangement, the skilled artisan will readily appreciate that the foregoing back torsion mechanisms 13, 13-1 and 13-2 could also be used where a one-piece shell is used.

Further, while the back torsion mechanisms 13, 13-1 and 13-2 are joined directly to the tilt control mechanism 21 which is a synchro-tilt mechanism, the back torsion mechanisms 13, 13-1 and 13-2 could alternatively be connected directly to the seat assembly separate from the connection of the seat assembly to the chair base. For example, the plates 81 and 82 (FIG. 7) or the mounting bracket 136 (FIG. 16) could be rigidly secured to the seat assembly such that the back does not tilt rearwardly relative to the seat. As a result, the back can still be tiltable sidewardly about the pivot axis P3.

Referring to FIGS. 18–23, another embodiment of the back torsion mechanism 13-3 is disclosed for use in an office chair 10-3 having a one-piece inner shell 146 instead of separate seat and back assemblies. A generally horizontal seat portion 147 and a generally vertical back portion 148 of the shell 146 respectively support the seat and back of a user. In particular, the seat portion 147 is secured to a tilt control mechanism 149 and the back portion 148 is secured to an L-shaped upright member 150 which extends upwardly from the tilt control mechanism 149. The inner shell 146 is covered by a cushion 151 to provide further support to a user.

The components of the chair 10-3 including the tilt control mechanism 149 and inner shell 146 are disclosed in copending U.S. patent application Ser. No. 08/702,120, entitled CHAIR, filed Aug. 23, 1996 (Atty Ref: Haworth Case 161B) which is a continuation of U.S. patent application Ser. No. 08/258, 020, filed Jun. 10, 1994. The disclosure of this latter application, in its entirety, is also incorporated herein by reference. Accordingly, a more detailed disclosure with respect to the chair 10-3 is not believed necessary.

In the arrangement disclosed herein in FIGS. 18–23, the L-shaped upright member 150 is pivotally connected at a front end thereof to the tilt control mechanism 149. The upright member 150 is disclosed in the above-identified U.S. patent application Ser. No. 08/702,120 although it has been modified to include the back torsion mechanism 13-3 and permit torsional movement of the chair back as described in more detail hereinafter. The one-piece shell 146 acts in combination with the back torsion mechanism 13-3 so as to serve as the centering means therefor.

More particularly, the chair 10-3 includes the tilt control mechanism 149 which is connected to a chair base 152. The tilt control mechanism 149 includes a control housing 153 which supports the seat portion 147 of the inner shell 146. The control housing 153 also pivotally supports the upright member 150 thereon for rearward tilting of the upright member 150 about a pivot axis P4.

The L-shaped upright member 147 preferably is formed of a generally horizontal member 156 which is pivotally supported on the control housing 151, and a generally vertical member 157 which extends upwardly from the horizontal member. The forward end of the horizontal member 156 is connected to the control housing 151, while the lower end of the vertical member 157 is connected to the rearward end of the horizontal member 156 by the back torsion mechanism 13-3.

Figure 21:
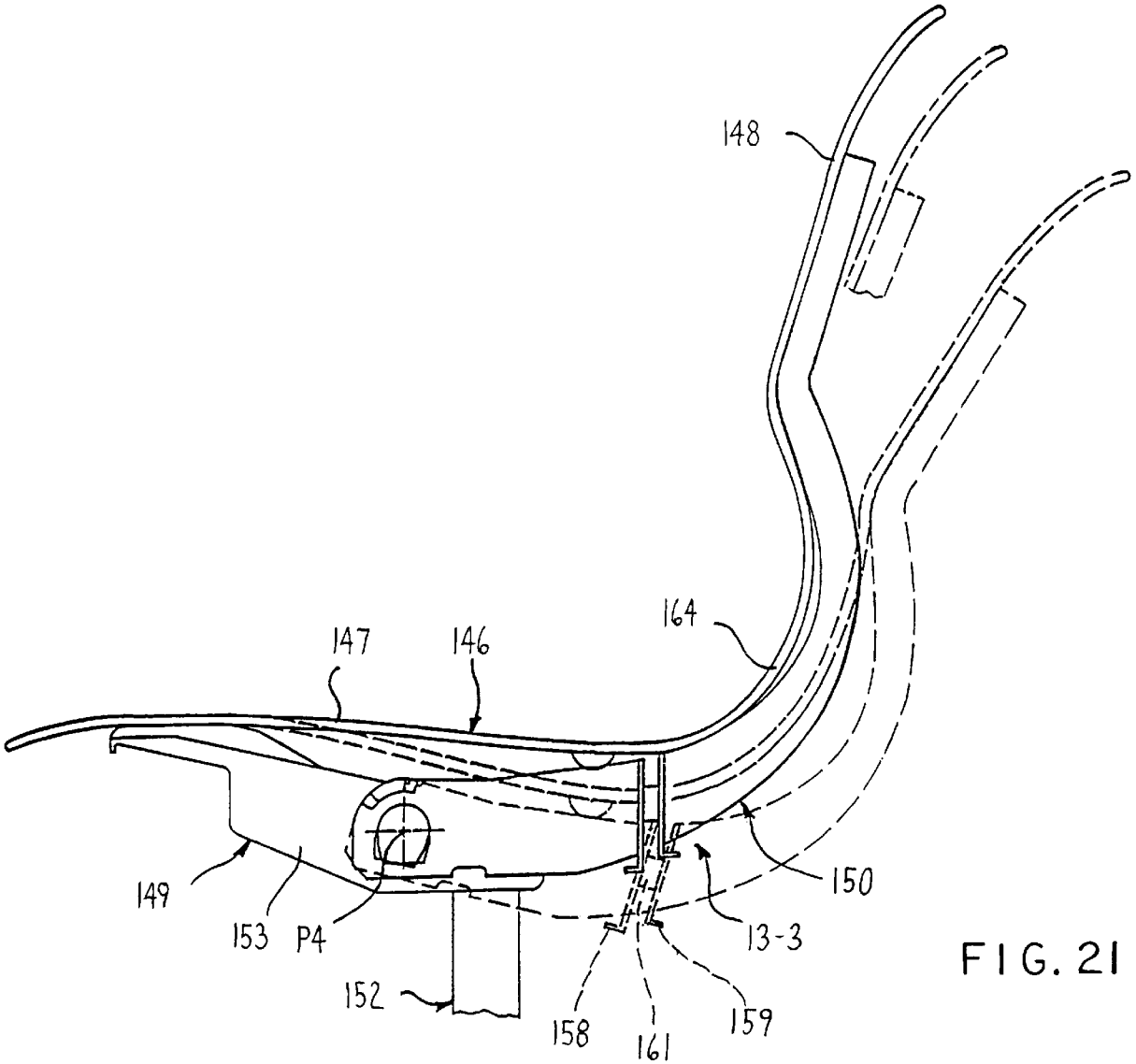
FIG. 21 is a partial side elevational view of the chair of FIG. 20.
Figure 22:
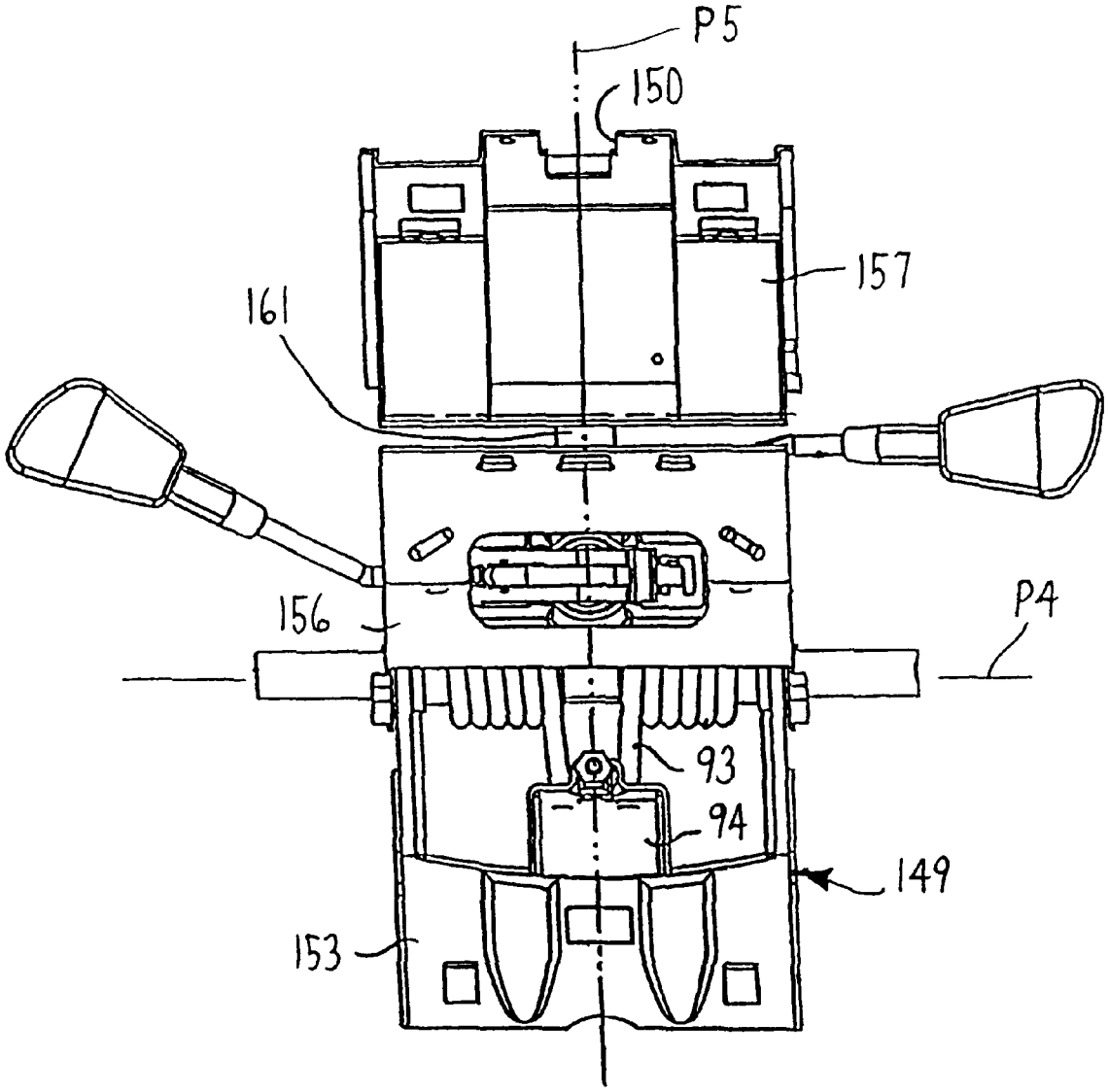
FIG. 22 is a top plan of the tilt control mechanism of the fourth embodiment.
Figure 23:
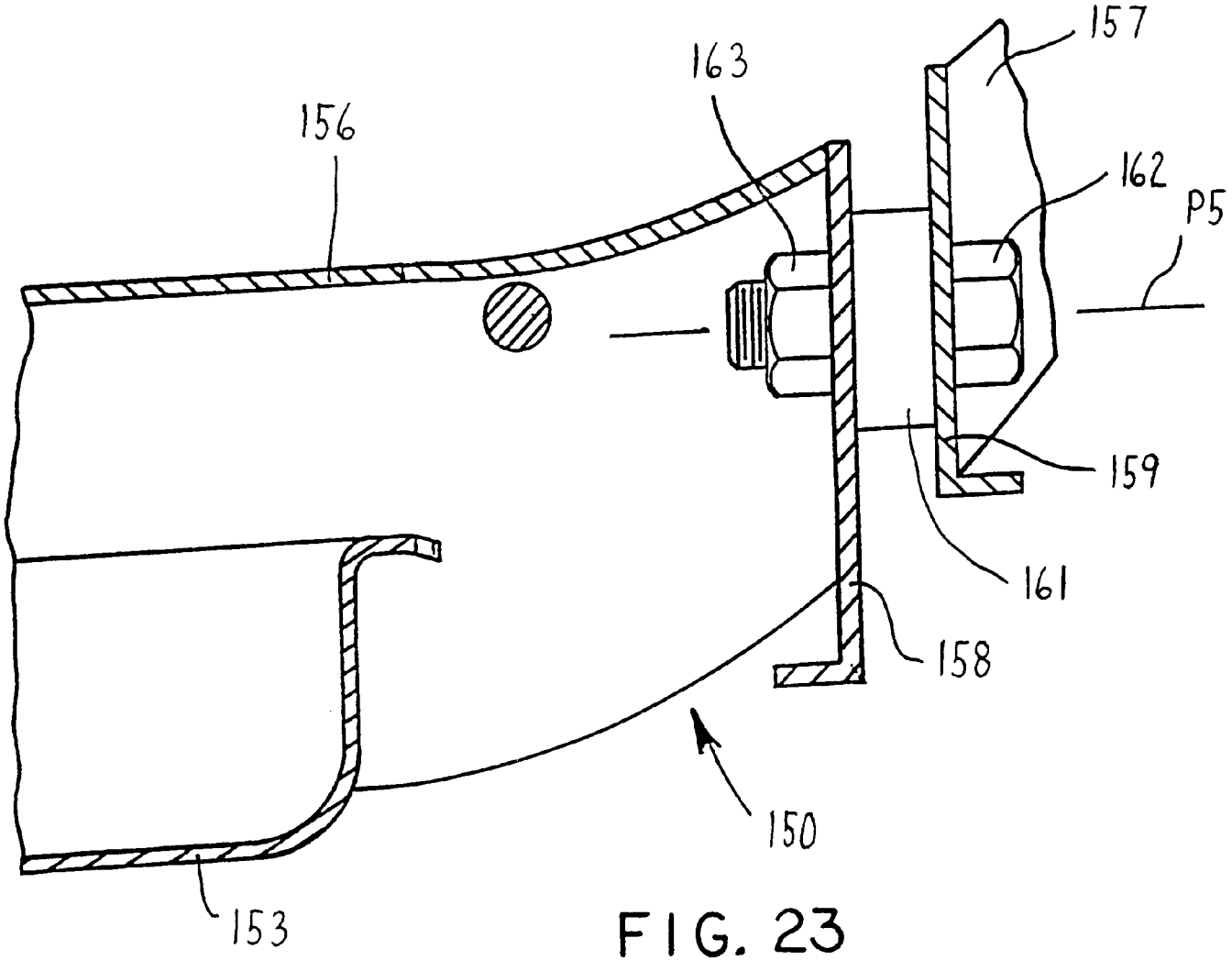
FIG. 23 is a partial side elevational view of the tilt control mechanism of FIG. 22.

Referring to FIG. 21–23, the adjacent ends of the horizontal and vertical members 156 and 157 include mounting plates 158 and 159 which are positioned in parallel relation. The back torsion mechanism 13-3 includes pivot means which connect between the mounting plates 158 and 159 to permit lateral pivoting of the vertical member 157 relative to the horizontal member 156 about axis P5. In particular, the pivot means (FIG. 23) comprise a thrust bearing 161 which is disposed in the space formed between the two mounting plates 158 and 159. The thrust bearing 161 is secured to the mounting plates 158 and 159 by a bolt 162 and nut 163 or other suitable fasteners. The bearing 161 thereby defines a forwardly-extending pivot axis P5 about which the vertical member 157 pivots.

Figure 18:
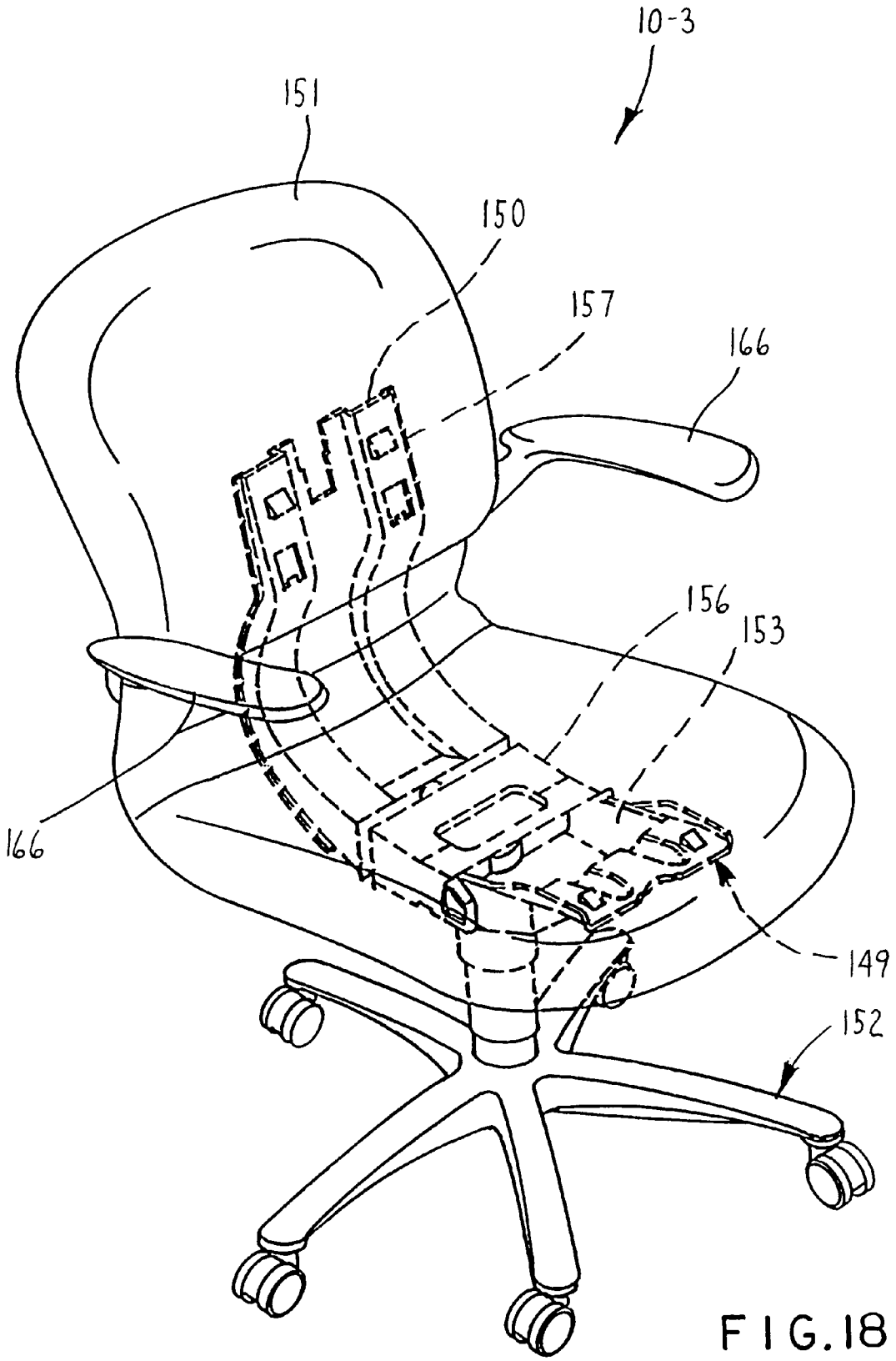
FIG. 18 is a perspective view of a fourth embodiment of the invention.
Figure 19:
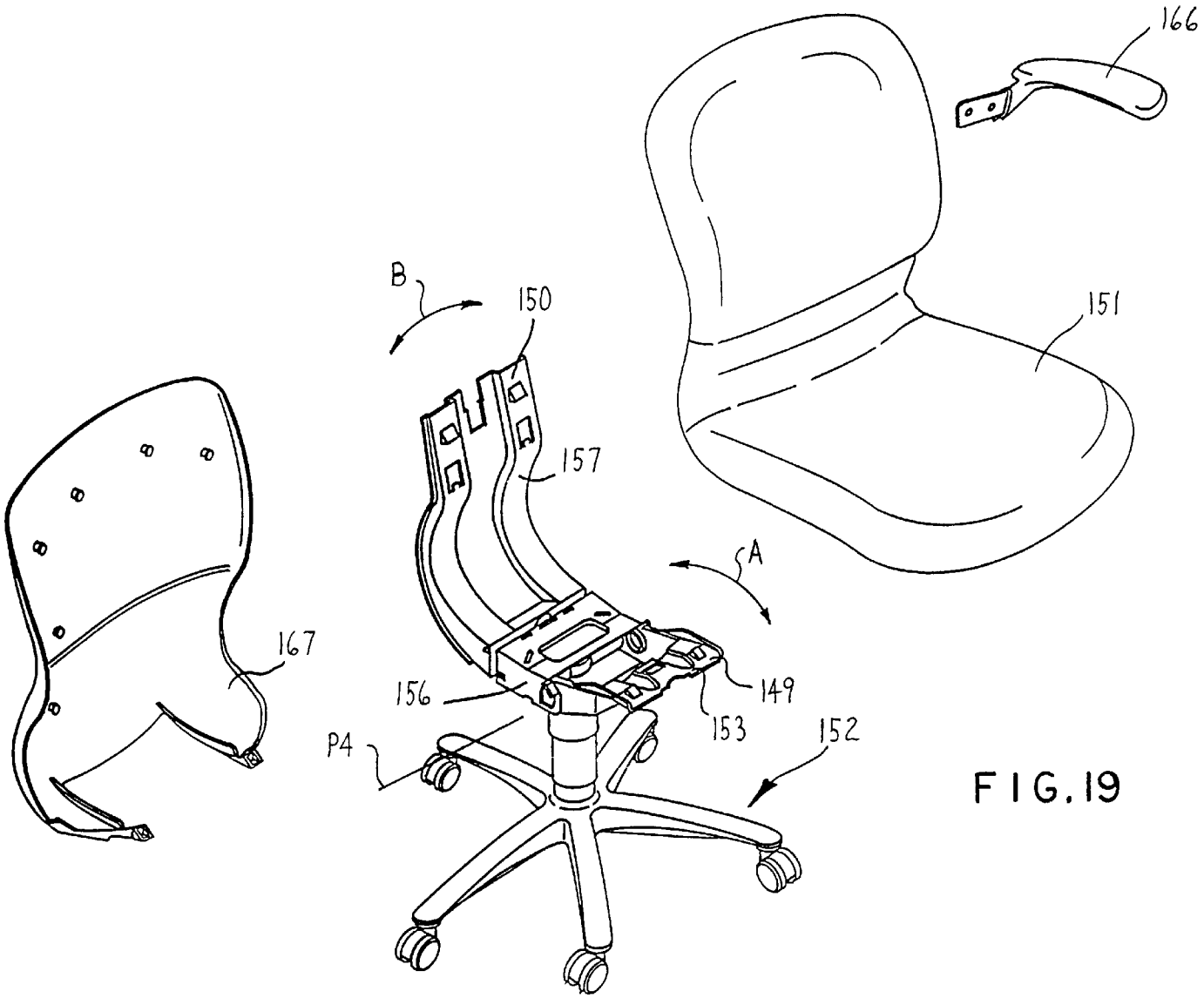
FIG. 19 is an exploded view of the chair of FIG. 18.
Figure 20:
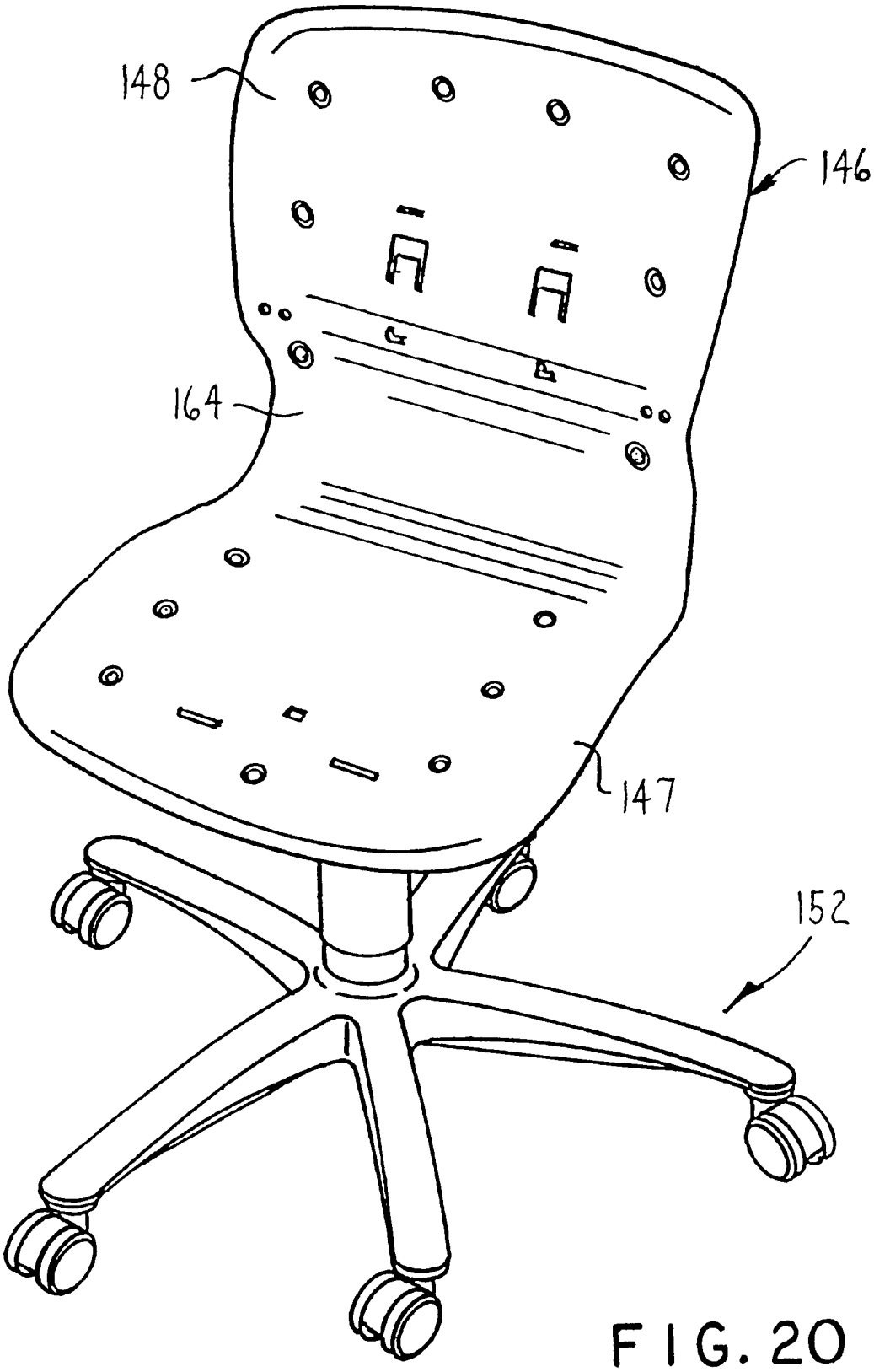
FIG. 20 is a perspective of the chair illustrated without cushions.

When the one-piece inner plastic shell 146 is connected both to the tilt control mechanism 149 and the vertical portion 159 of the upright member 150, the inner plastic shell 146 serves as centering means for the tilt control mechanism 13-3. In particular, the inner shell 146 is resiliently flexible in an arcuate shell part 164 which joins the seat portion 147 and back portion 148 together. As a result, the back portion 148 is movable sidewardly relative to a seat portion 147 thereof. The seat portion 147, however, is fixed in place on the tilt control mechanism 149. Since the inner shell 146 is resiliently flexible, the shell 146 urges the seat back to a normally upright position as seen in FIGS. 18–20 when not in use.

Further, the chair 10-3 also includes chair arms 166 on the opposite sides thereof. The rear ends of the chair arms 166 preferably are rigidly connected to a rear side of the vertical member 157 of the upright 150 such as by rigid support tubes or the like. As a result, the chair arms 166 move in unison with the chair back. The chair arms 166 further permit a user to lean thereon to assist in the lateral titling of the back. The connection of the chair arms 166 is enclosed by an outer shell 167 which covers the back surface of the inner shell 146.

Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A chair assembly comprising:

a chair base;

a seat assembly connected to said chair base, said seat assembly including a horizontally enlarged seat thereon;

a back assembly which includes an upright which is pivotally connected to a rear portion of said seat assembly and extends upwardly therefrom, said upright being tiltable relative to said seat assembly in a direction rearwardly away from a normal upright position toward a rearwardly tilted position, said upright having a lower first back member and an upright second back member extending upwardly away from said first back member and above said seat assembly for supporting the back of a user, a forward section of said lower first back member including a first rearward pivot pivotally connecting said upright to said seat assembly for said rearward tilting of said upright about a horizontal first pivot axis which extends sidewardly, a lower section of said upright second back member being pivotally connected to a rearward section of said first back member by a sideward pivot which defines a second horizontal pivot axis oriented transverse to said first pivot axis and extending in a generally forward-rearward direction such that said upright second back member pivots laterally about said second pivot axis.

2. A chair assembly according to claim 1, wherein said seat assembly is pivotally connected to said chair base by a second rearward pivot that defines a third pivot axis which extends sidewardly and permits rearward tilting of said seat assembly, said first rearward pivot being disposed rearwardly of said third pivot axis such that said back assembly is tiltable rearwardly during rearward tilting of said seat assembly.

3. A chair assembly according to claim 2, which further includes a synchro-tilt mechanism for synchronous tilting of said seat assembly and said back assembly, said synchro-tilt mechanism including a control housing connected to said chair base and further including said second rearward pivot which pivotally connects said seat assembly to said control housing and said first rearward pivot which pivotally connects said back assembly to said control housing, said synchro-tilt mechanism defining differential tilting of said seat assembly and said back assembly wherein said seat assembly tilts relative to said chair base at a rate which differs from a rate at which said back assembly tilts relative to said seat assembly.

4. A chair assembly according to claim 1, wherein said upright is generally L-shaped and is defined by said first back member and said second back member, said first back member being rearwardly elongated so as to extend rearwardly from said first pivot axis toward said sideward pivot, said sideward pivot being disposed below said seat assembly and proximate a rear section thereof.

5. A chair assembly according to claim 1, which further includes centering means acting on said upright second back member for urging said second back member laterally to an upright substantially vertical position.

6. A chair assembly according to claim 5, wherein said centering means comprise a semi-rigid but resiliently flexible inner shell having a generally L-shaped elevational configuration which defines seat and back shell parts, said seat and back shell parts being respectively connected to a fixed member of said seat assembly that is supported by said base and to said upright second back member, said seat and back shell parts being integrally joined together by an arcuate shell part, said arcuate shell part being resiliently flexible to permit sideward tilting of said upright second back member relative to said seat assembly by flexing thereof while urging said upright second back member to said vertical upright position.

7. A chair assembly according to claim 6, which includes a pair of chair arms rigidly supported by said back assembly so that said chair arms move therewith, a front section of said chair arms extending forwardly in a cantilevered relation proximate the opposite side edges of said seat assembly.

8. A chair assembly according to claim 5, wherein said sideward pivot means comprises a pivot bearing which is connected to said first and second back members and defines said second pivot axis.

9. A chair assembly according to claim 5, wherein said sideward pivot comprises an elongate pivot member rigidly connected to one of said first and second back members and a hollow bearing supported by the other of said first and second back members for rotatably supporting said pivot member therein, said upright second back member being sidewardly tiltable in response to rotation of said pivot member and said bearing relative to each other, said centering means comprising a transverse radial projection fixedly connected to said pivot member so as to rotate therewith and biasing means connected to said pivot member for rotatably biasing said pivot member to move said radial projection to a central position such that said upright is urged to said upright position.

10. A chair assembly according to claim 9, wherein said biasing means comprises a concave camming surface in which said radial projection is seated, said radial projection being rotatably and axially movable along said camming surface in response to a corresponding rotational and axial movement of said pivot member relative to said bearing as said upright second back member is tilted sidewardly, said biasing means further including spring means for axially urging said radial projection and said camming surface together with said radial projection being urged into a fully seated position in said camming surface wherein said back assembly upright is maintained in said upright position.

11. A chair assembly comprising:

a base;

a seat assembly which is connected to said base and defines an upward facing seat surface; and a back assembly for supporting a back of a user which includes a lower end connected to said seat assembly and an upward end extending upwardly above said seat assembly, said lower end being joined to said seat assembly by a lateral tilt mechanism, said lateral tilt mechanism comprising a first pivot connecting said back assembly to said seat assembly such that said back assembly pivots laterally relative to said seat assembly about a horizontal first pivot axis which extends rearwardly and is disposed proximate said seat surface, said back assembly defining a back surface which faces forwardly such that a back of a user is supported solely by said back surface, said back assembly being movable laterally about said first pivot axis between an upright position and sidewardly tilted positions on opposite sides of said upright position, said lateral tilt mechanism further including a centering device which biases said back assembly laterally away from said sidewardly tilted positions to said upright position independently of a user.

12. A chair assembly according to claim 11, wherein said centering device comprises a semi-rigid but resiliently flexible inner shell having a generally L-shaped elevational configuration which defines seat and back shell parts, said seat and back shell parts respectively defining said seat assembly and said back assembly and being integrally joined together by an arcuate shell part, said arcuate shell part being flexible to permit relative sideward tilting of said back assembly relative to said seat assembly for said lateral tilting between said upright position and said sidewardly tilted positions and being resilient for said biasing of said back assembly to said upright position.

13. A chair assembly according to claim 12, wherein said back assembly includes an upright which comprises a rearwardly extending first support member connected to said seat assembly and an upwardly extending second support member which defines an L-shape for said upright, a rearward end of said first support member and a lower end of said second support member being pivotally connected together by said first pivot.

14. A chair assembly according to claim 13, wherein said first pivot comprises a thrust bearing oriented so as to define said first pivot axis.

15. A chair assembly according to claim 11, wherein said first pivot comprises an elongate pivot rod projecting axially from one of said back assembly and said seat assembly and a hollow cylindrical member supported by the other of said back assembly and said seat assembly for rotatably supporting said pivot rod therein, said pivot rod and said hollow cylindrical member defining said first pivot axis.

16. A chair assembly according to claim 15, wherein said centering device comprises a transverse centering pin projecting radially from said pivot rod so as to rotate therewith, said centering device including biasing means for rotatably biasing said transverse pin to a central position such that said back assembly is moved to said upright position.

17. A chair assembly according to claim 16, wherein said biasing means comprises a concave camming surface in which said centering pin is seated, said centering pin being rotatably and axially movable along said camming surface in response to sideward tilting of said back assembly, said biasing means further including spring means for axially urging said centering pin and said camming surface together with said centering pin being urged into a fully seated position in said camming surface wherein said back assembly is maintained in said upright position.

18. A chair assembly according to claim 11, which includes a pair of chair arms rigidly supported by said back assembly so that said arms move sidewardly therewith, front sections of said chair arms extending forwardly along the opposite side edges of said seat assembly and being rigidly supported by the back assembly so that forces applied to said chair arms assist in sideward tilting of said back assembly.

19. A chair assembly according to claim 11, wherein said seat assembly defines an upward facing seat surface which extends rearwardly to a rear edge thereof, said back surface having a lower edge which is disposed proximate said rear edge of said seat surface to support a lower back of a user.

20. A chair assembly comprising:

a freestanding base which includes a lower section supported on a floor and an upper section extending vertically therefrom; and a seat-back arrangement supported on said upper section of said base to support a user thereon, said seat-back arrangement including a horizontally enlarged seat and a vertically enlarged back which extends upwardly from a rear section of said seat, said seat-back arrangement including a first pivot which defines a first pivot axis which extends horizontally in a sideward direction, at least said back being tiltable rearwardly relative to said base about said first pivot axis, said seat-back arrangement further including a second pivot which defines a second pivot axis which extends horizontally in a forward-rearward direction such that said back is tiltable sidewardly relative to said seat, said first pivot axis and said second pivot axis being disposed below said seat and being oriented transverse to each other.

21. A chair assembly according to claim 20, wherein said back is connected to said seat by said first pivot and said second pivot such that said back is rearwardly and sidewardly tiltable relative to said seat.

22. A chair assembly according to claim 20, wherein said tilt mechanism further includes a third pivot which connects said seat to said base and defines a third pivot axis that extends horizontally in said sideward direction such that said seat is pivotable relative to said base.

23. A chair assembly according to claim 20, wherein said seat and said back are tiltable rearwardly wherein said back tilts rearwardly in response to tilting of said seat.

24. A chair assembly according to claim 20, wherein said second pivot includes a pivot pin and a bearing supporting said pivot pin, said bearing and said pivot pin being fixed relative to said back and being movable with said back relative to said seat in response to said rearward tilting of said back.

25. In a chair assembly comprising a base, a seat assembly which is connected to said base and defines an upward facing seat surface, and a back assembly for supporting a back of a user which includes a lower end connected to said seat assembly and an upward end extending upwardly above said seat assembly, said back assembly defining a forward facing back surface, comprising the improvement wherein said lower end is joined to said seat assembly by a lateral tilt mechanism such that said back surface extends upwardly away from said seat surface and a back of an occupant is supported solely by said back surface, said lateral tilt mechanism comprising a first pivot connecting said back assembly to said seat assembly such that said back assembly is tiltable laterally relative to said seat assembly about a first pivot axis which extends generally rearwardly and horizontally, said back assembly being tiltable laterally about said first pivot axis between an upright position and a sidewardly tilted position and said lateral tilt mechanism further including a centering device which biases said back assembly laterally to said upright position independently of a user, said lateral tilt mechanism further including a lock device which prevents lateral tilting when engaged and permits lateral tilting when disengaged, said lock device including an actuator part which engages and disengages said lock device.

26. A chair assembly according to claim 25, wherein said actuator part is accessible from an exterior of said chair to permit manual operation of said actuator part.

27. A chair assembly according to claim 26, wherein said lock device includes an axially elongate shaft which is movable axially by said actuator part to engage and disengage said lock device.

28. A chair assembly according to claim 27, wherein said lock device includes a fixed lock member having an opening therein, said shaft being movable into said opening to engage said lock device and movable out of said opening to disengage said lock device.

29. In a chair assembly comprising a base, a seat assembly which is connected to said base and defines an upward facing seat surface, and a back assembly for supporting a back of a user which includes a lower end connected to said seat assembly and an upward end extending upwardly above said seat assembly, said back assembly defining a forward facing back surface, comprising the improvement wherein said lower end is joined to said seat assembly by a lateral tilt mechanism such that said back surface extends upwardly away from said seat surface and a back of an occupant is supported solely by said back surface, said lateral tilt mechanism comprising a first pivot connecting said back assembly to said seat assembly such that said back assembly is tiltable sidewardly relative to said seat assembly about a first pivot axis which extends rearwardly, said back assembly being tiltable laterally about said first pivot axis between an upright position and a sidewardly tilted position, said lateral tilt mechanism further including a centering device which biases said back assembly laterally to said upright position independently of a user, said centering device applying a biasing force for said biasing and further including an adjustment device to adjust said biasing force.

30. A chair assembly according to claim 29, wherein said centering device includes a resilient biasing member having opposite ends which are movable relative to each other, said adjustment device acting on at least one of said ends to move said one of said ends relative to the other of said ends to adjust said biasing force.

31. A chair assembly according to claim 30, wherein said adjustment device includes a manually actuatable part which is accessible from an exterior of said back assembly to move said one end of said resilient biasing member.

32. A chair assembly according to claim 29, wherein said lateral tilt mechanism further includes a lock device which prevents lateral tilting of said back assembly when engaged and permits said lateral tilting when disengaged, said lock device including a manually-actuatable actuator part which engages and disengages said lock device.

33. A chair assembly comprising:

a base;

a seat assembly connected to said base; and a back assembly for supporting a back of a user which includes a lower end connected to said seat assembly and an upward end extending upwardly above said seat assembly, said lower end being joined to said seat assembly by a lateral tilt mechanism, said lateral tilt mechanism comprising a first pivot connecting said back assembly to said seat assembly such that said back assembly pivots laterally relative to said seat assembly about a horizontal first pivot axis which extends rearwardly, said first pivot comprising a pivot shaft connected to one of said back assembly and said seat assembly and a bearing supported by the other of said back assembly and said seat assembly which rotatably supports said pivot shaft, said back assembly being movable laterally about said first pivot axis between an upright position and sidewardly tilted positions on opposite sides of said upright position wherein said sidewardly tilted positions define an acute angle through which said back assembly is movable laterally, said lateral tilt mechanism further including a centering mechanism which biases said back assembly laterally away from said sidewardly tilted positions to said upright position, said centering mechanism including a radial projection on said pivot shaft which rotates therewith and a biasing member acting on said first pivot such that a rotatable biasing force is applied to said radial projection during lateral tilting to bias said back assembly toward said upright position.

34. A chair assembly according to claim 33, wherein said centering mechanism includes a concave camming surface in which said radial projection is seated, said radial projection being rotatably and axially movable along said camming surface in response to sideward tilting of said back assembly, said biasing member biasing said pivot shaft axially to generate said rotatable biasing force on said radial projection.

35. A chair assembly according to claim 34, wherein said biasing member acts axially between said pivot shaft and said bearing.

36. A chair assembly according to claim 35, wherein said centering mechanism includes a biasing force adjustment device which acts on said biasing member to adjust said biasing force.

37. A chair assembly according to claim 33, wherein said lateral tilt mechanism includes fixed stops which define said sidewardly tilted positions.

38. A chair assembly according to claim 33, wherein said biasing member is resiliently deformable to a maximum deformation, said maximum deformation preventing lateral pivoting of said back assembly such that said sidewardly tilted positions are defined by said maximum deformation.

* * * * *

UNITED STATES PATENT AND TRADEMARK OFFICE

CERTIFICATE OF CORRECTION

PATENT NO. : 5,951,109
DATED : September 14, 199
INVENTOR(S) : Richard N. Roslund, Jr., et al.

It is certified that error appears in the above-identified patent and that said Letters Patent is hereby corrected as shown below:

Column 15, line 61; delete "means".

Signed and Sealed this

Nineteenth Day of September, 2000

*Attest:*

Q. TODD DICKINSON

*Attesting Officer*

*Director of Patents and Trademarks*